US010356886B1

(12) United States Patent
Cooley et al.

(10) Patent No.: US 10,356,886 B1
(45) Date of Patent: Jul. 16, 2019

(54) APPARATUS, METHOD, AND SYSTEM FOR THEATRICAL LIGHTING OF POLES OR OTHER STRUCTURES FROM A MOUNTED POSITION ON THE POLE OR OTHER STRUCTURE

(71) Applicant: Musco Corporation, Oskaloosa, IA (US)

(72) Inventors: Patrick K. Cooley, Muscatine, IA (US); Ryan P. Cady, Sully, IA (US)

(73) Assignee: Musco Corporation, Oskaloosa, IA (US)

( * ) Notice: Subject to any disclaimer, the term of this patent is extended or adjusted under 35 U.S.C. 154(b) by 11 days.

(21) Appl. No.: 15/884,333

(22) Filed: Jan. 30, 2018

(51) Int. Cl.

| | |
|---|---|
| ***F21S 8/08*** | (2006.01) |
| ***F21V 21/116*** | (2006.01) |
| ***H05B 37/02*** | (2006.01) |
| ***F21V 29/76*** | (2015.01) |
| ***F21V 21/30*** | (2006.01) |

(Continued)

(52) U.S. Cl.
CPC ..... *H05B 37/0272* (2013.01); *F21S 8/086* (2013.01); *F21V 21/116* (2013.01); *F21V 21/30* (2013.01); *F21V 29/76* (2015.01); *H05B 33/0845* (2013.01); *H05B 33/0863* (2013.01); *F21V 3/00* (2013.01); *F21W 2131/105* (2013.01); *F21W 2131/406* (2013.01); *F21Y 2113/13* (2016.08); *F21Y 2115/10* (2016.08)

(58) Field of Classification Search
CPC ..... H05B 37/0272; H05B 33/0845; H05B 33/0863; F21S 8/085; F21S 8/086; F21S 8/088; F21S 6/008; F21V 21/10; F21V 29/76; F21V 21/30; F21V 3/00; F21Y 2113/13; F21W 2131/105; F21W 2131/406
See application file for complete search history.

(56) References Cited

U.S. PATENT DOCUMENTS 2,456,179 A * 12/1948 Finer ..... F21S 8/086 362/431
4,190,881 A 2/1980 Drost et al.
(Continued)

FOREIGN PATENT DOCUMENTS

JP 06084403 A 3/1994

OTHER PUBLICATIONS

Gordin, Myron et al, unpublished Pending Utility U.S. Appl. No. 15/782,039, Sharp Cutoff LED Lighting Fixture and Method of Use, filed Oct. 12, 2017.

*Primary Examiner* — Alan B Cariaso
(74) *Attorney, Agent, or Firm* — Jessica R. Boer

(57) ABSTRACT

A lighting system is designed to include (i) primary lighting fixtures at a poletop position to provide primary lighting at a target area so to ensure specific light levels, lighting uniformity, or the like needed to adequately perform specific tasks during nighttime or low ambient light conditions; and (ii) secondary lighting fixtures at a mounted position on the same pole, but other than poletop, to provide targeted lighting on the pole itself rather than the target area. A method of providing enhanced spectator experience through theatrical effects is achieved by varying intensity, color, duty cycle, or other operating characteristics of the secondary lighting fixtures, including coordination with the primary lighting fixtures to provide multi-dimensional theatrical effects at or near a poletop location.

21 Claims, 25 Drawing Sheets

(51) Int. Cl.

| | |
|---|---|
| ***H05B 33/08*** | (2006.01) |
| *F21V 3/00* | (2015.01) |
| *F21W 131/406* | (2006.01) |
| *F21Y 113/13* | (2016.01) |
| *F21W 131/105* | (2006.01) |
| *F21Y 115/10* | (2016.01) |

(56) References Cited

U.S. PATENT DOCUMENTS

| | | | | |
|---|---|---|---|---|
| 4,459,649 | A | 7/1984 | Shaneour | |
| 5,426,574 | A * | 6/1995 | Carolfi | F21S 8/086 362/231 |
| 5,595,440 | A * | 1/1997 | Gordin | F21S 8/086 362/243 |
| 5,600,537 | A | 2/1997 | Gordin et al. | |
| 5,921,663 | A | 7/1999 | Flammer | |
| 6,681,110 | B1 | 1/2004 | Crookham et al. | |
| 6,705,744 | B2 | 3/2004 | Hubbell et al. | |
| 7,209,958 | B2 | 4/2007 | Crookham et al. | |
| 7,778,635 | B2 | 8/2010 | Crookham et al. | |
| 8,203,501 | B2 | 6/2012 | Kim | |
| 8,300,219 | B1 | 10/2012 | Gordin et al. | |
| 8,337,058 | B2 | 12/2012 | Gordin et al. | |
| 8,368,321 | B2 | 2/2013 | Chemel et al. | |
| 8,537,516 | B1 | 9/2013 | Chelcun | |
| 8,605,394 | B2 | 12/2013 | Crookham et al. | |
| 8,614,869 | B1 | 12/2013 | Chelcun et al. | |
| 8,789,967 | B2 | 7/2014 | Gordin et al. | |
| 9,026,104 | B2 | 5/2015 | Crookham et al. | |
| 9,189,996 | B2 | 11/2015 | Casper et al. | |
| 9,631,795 | B2 | 4/2017 | Gordin et al. | |
| 9,681,510 | B2 | 6/2017 | Van de Ven | |
| 2011/0149582 | A1 | 6/2011 | McKee | |
| 2016/0286629 | A1 * | 9/2016 | Chen | H05B 37/0272 |

* cited by examiner

Local Access

Control Center Access

APPARATUS, METHOD, AND SYSTEM FOR THEATRICAL LIGHTING OF POLES OR OTHER STRUCTURES FROM A MOUNTED POSITION ON THE POLE OR OTHER STRUCTURE

I. TECHNICAL FIELD OF INVENTION

The present invention generally relates to providing targeted lighting for theatrical effects such as, e.g., synchronization to music during sporting events. More specifically, the present invention relates to providing secondary lighting of a particular size, shape, intensity, and/or color on a surface other than the surface or area being primarily lit (i.e., the target area) so to provide theatrical effects in a manner that does not interfere with the primary lighting, and in some cases, highlights or enhances the primary lighting.

II. BACKGROUND OF THE INVENTION

Targeted lighting—lighting of a particular size, shape, intensity, color, and/or aiming angle—has long been used to enhance the spectator experience. This targeted lighting often operates on a periodic trigger such as, e.g., when an actor hits a mark on a stage, when a team scores a touchdown, or when a song strikes a particular note, to further enhance the spectator experience and provide theatrical effect. The periodicity of the trigger could be random (as with scoring during a sporting event), predetermined (as when coinciding with a particular note of a recorded song), or even semi-random (as when an actor hits a mark on a stage during a scene—which will differ in timing from performance to performance). Other times there is no trigger per se other than that to turn on and that to turn off (as when a fountain is lit beginning at sunset and ending at sunrise).

Regardless of whether this targeted lighting is triggered or not, the purpose is for theatrical effect, not primary illumination. Take, for example, the aforementioned fountain which is illuminated from sunset to sunrise. The purpose of the targeted lighting is to highlight the beauty of the water and create an ambiance—not to provide specific light levels, lighting uniformity, or the like needed to adequately perform specific tasks during nighttime conditions. Even if there is no ambient light and no other lighting of the fountain, the targeted lighting is considered secondary lighting.

However, there are applications that require primary lighting during nighttime or low ambient light conditions and may also benefit from secondary lighting for theatrical effects; outdoor sporting events are one example. To ensure playability during nighttime or low ambient light conditions, primary lighting must be provided from mounted locations and directed towards the field of play—this is well known. In fact, in addition to mounting heights, mounting locations relative to the field, light levels, and lighting uniformity, color contrast, modeling, and the like are also considered to define both the quantity and quality of primary lighting based on the sport, level of play, and whether or not the event is televised; see, for example, IES lighting standard RP-6-15. So it can be appreciated that the placement and providing of primary illumination is highly regulated in sports lighting.

However, herein lies a problem when one considers secondary lighting of the target area for the purpose of providing theatrical effects to enhance the spectator experience. Each pole or mounting structure has a particular loading capacity which can vary depending on wind conditions for the region, existing features such as windbreaks and buildings, effective projected area (EPA) of the lighting fixtures mounted at or near the top of the pole or mounting structure, and the like, and which cannot be exceeded by adding a number of extra lighting fixtures at the poletop to provide secondary lighting. Extra lighting fixtures are needed at the poletop to provide secondary lighting at the target area because primary lighting fixtures often lack the ability to provide the desired theatrical effects; a lack of RGB-type color emission and rapid communication protocol to enable synchronization are two examples. What often happens in the state of the art is (i) primary lighting is used for a limited selection of theatrical effects, (ii) poletop secondary lighting is provided to the detriment of primary illumination of the target area (e.g., by taking the place of some subset of primary lighting fixtures on a pole), or (iii) additional or more substantial mounting structures are used to accommodate both poletop primary and secondary lighting fixtures. None of these are desirable approaches to providing theatrical effects to enhance the spectator experience in applications that require primary lighting during nighttime or low ambient light conditions. The first state-of-the-art approach limits the ambiance, aesthetic, or other theatrical effect which is achievable using only the primary lighting fixtures. For example, the primary lighting fixtures may be synchronized to music during a halftime show (assuming both a rapid communication protocol as well as programmable controllers are present), but no color changing is possible; this is because the industry requires primary lighting be varying degrees of what is perceived as white (color temperature being dependent upon the various factors already discussed) with a high color rendering index (CRI). The second state-of-the-art approach typically results in (i) light levels at the target area which are not acceptable (e.g., due to the substitution of secondary lighting fixtures which are only emitting during theatrical effects), (ii) color rendering at the target area which is not acceptable (e.g., due to running RGB-type secondary lighting fixtures in conjunction with primary lighting fixtures), and/or (iii) in reduced system life (e.g., due to running remaining primary fixtures at high currents to increase luminous output to compensate for the supplanted primary fixtures). Finally, the third state-of-the-art approach may simply be too costly or even prohibited due to site conditions or zoning.

It would be beneficial if the spectator experience could be enhanced through theatrical effects without interfering with or negatively impacting the primary lighting of a target area; it would be even more beneficial if the secondary lighting providing the theatrical effects could highlight or enhance the primary lighting. Thus, there is room for improvement in the art.

III. SUMMARY OF THE INVENTION

There are applications that require primary lighting during nighttime or low ambient light conditions that may also benefit from secondary lighting for theatrical effects; sporting events are one example. To ensure playability during nighttime or low ambient light conditions, primary lighting must be provided from mounted locations and directed towards the field of play. Including secondary lighting for theatrical effects from the same mounting position as primary lighting (i.e., from a poletop position and directed towards the target area) is undesirable because of a negative impact on the primary lighting and/or cost. Suitable alternatives are lacking in the art.

It is therefore a principle object, feature, advantage, or aspect of the present invention to improve over the state of the art and/or address problems, issues, or deficiencies in the art.

Presented herein are apparatus and methods for providing secondary lighting of a particular size, shape, intensity, and/or color on a surface other than the surface or area being primarily lit (i.e., the target area) so to provide theatrical effects in a manner that does not interfere with the primary lighting. One possible method includes mounting secondary lighting fixtures to the same pole or mounting structure as the primary lighting fixtures, but at a position other than poletop. Said secondary lighting fixtures are directed or otherwise aimed in a generally opposite fashion from the primary lighting fixtures so to illuminate a section of the pole above or proximate the target area instead of the target area. Unlike ground mounted secondary lighting for theatrical effects (such as is used in the lighting of façades or fountains), by mounting the secondary lighting fixtures to the pole or other structure, player safety at the sporting event is preserved. Furthermore, since the secondary lighting is directed to a section of pole or other mounting structure below the primary lighting, a spectator's gaze is drawn to the pole and near the primary lighting fixtures (rather than the target area), which permits the opportunity to highlight or enhance the primary lighting—which is in the same field of view. Particularly for LED lighting systems which have a wide dimming range and small source size, comparatively small changes can be made to dimming, duty cycle, or other operational characteristics and yield a dramatic theatrical effect when a spectator is looking near the primary lighting fixtures instead of the target area. For example, since glare control has become so evolved in LED lighting systems—so much so that it is not uncommon for properly designed LED lighting systems to appear completely dark at night (e.g., because there is no longer uncontrolled light striking crossarms, fixture visors, and poles)—contrast is so high at poletop (as compared to at the target area) that a much lower comparative current can be used to provide theatrical effect when a spectator is looking near the primary lighting fixtures instead of the target area. Not only is this a benefit in terms of operating cost and system life, this approach represents a shift from conventional wisdom in lighting design where it has for many years been believed that if a spectator is looking at a pole or primary lighting fixtures it is because of onsite glare or poor design; namely, that something is being done wrong. Aspects according to the present invention run contrary to that notion, and so by virtue of the unexpected challenge to conventional wisdom adds to the overall theatrical effect and enhancement of the spectator experience.

One possible apparatus includes a plurality of RGB-type LEDs in a secondary lighting fixture which is mounted with primary lighting fixtures to a common pole at some spaced apart distance at an orientation such that the secondary lighting fixtures are emitting upward or otherwise generally away from the target area and towards the pole, and the primary lighting fixtures are at a poletop position and emitting downward or otherwise generally away from the pole and towards the target area. As previously stated, LEDs have a wide dimming range and small source size, and additionally offer a wide range of color points, color temperatures, and CRIB when operated in large number in lighting fixtures, and so are well suited to aspects of the present invention (though the invention is not limited to such). The primary lighting fixtures (also LED) are aimed downwardly towards the target area so to provide primary illumination, though in some situations the primary lighting fixtures may be highlighted by operation of the secondary lighting fixtures such that the primary lighting fixtures may play a secondary role in enhancing the theatrical effects.

Also presented herein are apparatus for a number of different possible communication platforms and protocols, as well as a number of wiring schemes, to facilitate control of both primary and secondary LED lighting fixtures for the purpose of coordinating primary and secondary lighting. Coordination of both primary and secondary lighting presents an opportunity for multi-dimensional theatrical effects; namely, the ability to creates a 3D theatrical effect as opposed to, for example, state-of-the-art approaches which only illuminate a 2D plane (e.g., the face of a building or a playing field).

These and other objects, features, advantages, or aspects of the present invention will become more apparent with reference to the accompanying specification and claims.

IV. BRIEF DESCRIPTION OF THE DRAWINGS

From time-to-time in this description reference will be taken to the drawings which are identified by figure number and are summarized below.

FIG. 1 illustrates a typical sports lighting application which requires primary lighting during nighttime or low ambient light conditions, and which may also benefit from secondary lighting for theatrical effects.

FIG. 2A-C illustrate various views of typical LED lighting fixtures used in the sports lighting application of FIG. 1 to provide primary lighting of the target area; here, a field of play and an aerial space above the field of play. FIG. 2A illustrates an enlarged perspective view, FIG. 2B illustrates a further enlarged cutaway side view of an upper portion of FIG. 2A, and FIG. 2C illustrates a further enlarged cutaway top view of an upper portion of FIG. 2A; note that for clarity, hatching has been omitted from pole and crossarm cutaways in FIGS. 2B and C.

FIG. 3 illustrates a partial wiring diagram for a single LED lighting fixture of FIGS. 2A-C mounted to Pole A of FIG. 1.

FIG. 4 diagrammatically illustrates partial primary illumination of the target area of FIG. 1 from an array of primary lighting fixtures at the Pole B mounting location.

FIG. 5 illustrates the typical sports lighting application of FIG. 1 as modified according to aspects of the present invention so to provide targeted lighting on a surface other than the target area; here, the pole common to the primary and secondary lighting fixtures.

FIGS. 6A-C illustrate various views of the LED lighting system of FIGS. 2A-C as modified according to aspects of the present invention in accordance with FIG. 5 to include one or more secondary LED lighting fixtures. FIG. 6A illustrates an enlarged perspective view, FIG. 6B illustrates a further enlarged cutaway side view of an upper and lower portion of FIG. 6A, and FIG. 6C illustrates a further enlarged cutaway top view of an upper portion of FIG. 6A; note that for clarity, hatching has been omitted from pole and crossarm cutaways in FIGS. 6B and C.

FIGS. 7A-C illustrate the partial wiring diagram of FIG. 3 as modified according to aspects of the present invention in accordance with FIG. 5. FIG. 7A illustrates a first partial wiring diagram in which a secondary LED lighting fixture at Pole A differs significantly in operating requirements from the primary LED lighting fixtures at Pole A; note that for clarity only one primary LED lighting fixture with associated driver is illustrated, and the secondary LED lighting fixture illustrated includes a self-contained driver (and so a separate driver is not illustrated). FIG. 7B illustrates a second partial wiring diagram in which the secondary LED lighting fixture at Pole A does not differ significantly in operating requirements from the primary LED lighting fixtures at Pole A; again, for clarity only one primary LED lighting fixture with associated driver is illustrated, and the secondary LED lighting fixture illustrated includes a self-contained driver (and so a separate driver is not illustrated). FIG. 7C illustrates various possible communication and wiring protocols, platforms, and configurations for either the wiring configurations of FIGS. 7A and 7B.

FIGS. 8A-G illustrate various views of a primary LED lighting fixture which could also form the basis for a custom secondary LED lighting fixture to provide theatrical effects according to aspects of the present invention. FIG. 8A illustrates a perspective view, FIG. 8B illustrates an enlarged back view, FIG. 8C illustrates an enlarged front view, FIG. 8D illustrates an enlarged bottom view, FIG. 8E illustrates an enlarged top view, FIG. 8F illustrates an enlarged right side view, and FIG. 8G illustrates an enlarged left side view.

FIG. 9 diagrammatically illustrates the partial primary illumination of the target area of FIG. 1 from an array of primary lighting fixtures at the Pole B mounting location, as supplemented according to aspects of the present invention to highlight a portion of Pole B below the primary lighting fixtures.

FIG. 10 diagrammatically illustrates coordination of primary and secondary lighting fixtures for theatrical effect according to aspects of the present invention; here for similar secondary illuminations and differing primary illuminations between poles at the same sports lighting application.

FIG. 11 diagrammatically illustrates coordination of primary and secondary lighting fixtures for theatrical effect according to aspects of the present invention; here for no primary illumination and differing colors of secondary illumination between poles at the same sports lighting application.

FIG. 12 diagrammatically illustrates some possible theatrical effects which, if desired, could be coordinated across some number of poles so to facilitate such things as chase sequences or waves at a single or across multiple target areas according to aspects of the present invention.

V. DETAILED DESCRIPTION OF EXEMPLARY EMBODIMENTS

A. Overview

Figure 1:
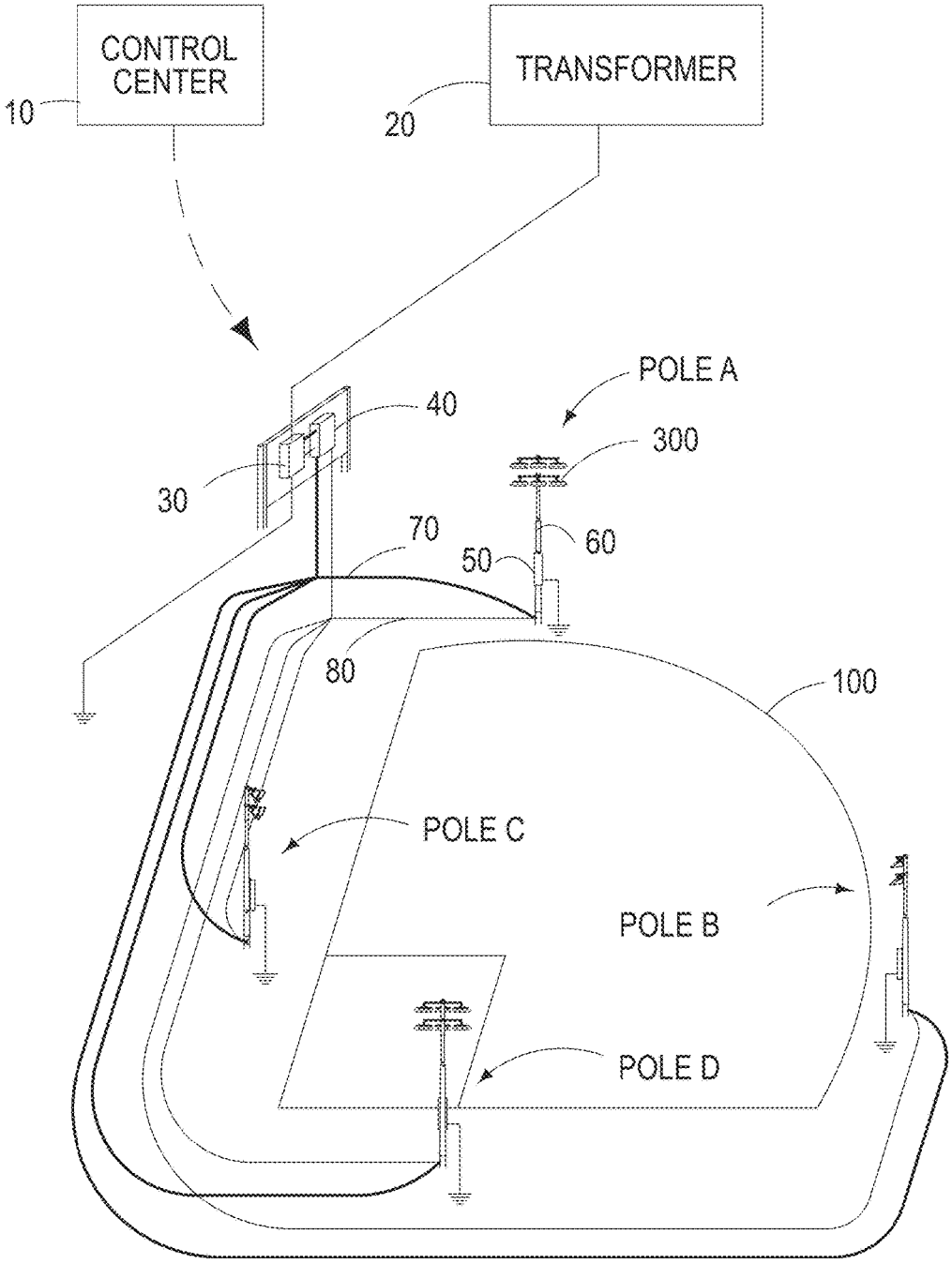
Prior Art Figure 1

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Regarding terminology, reference is given herein to primary and secondary illumination, as well as primary and secondary lighting fixtures and lighting systems. As previously discussed, the main purpose of primary lighting is to provide lighting of specific light levels, lighting uniformity, or the like needed to adequately perform specific tasks during nighttime or low ambient light conditions; alternatively, the main purpose of secondary lighting is to provide lighting of a particular size, shape, intensity, color, and/or aiming angle so to highlight a feature, create an ambiance, evoke an aesthetic, or otherwise produce a theatrical effect. While both primary lighting and secondary lighting are targeted lighting insomuch that they are purposefully designed to play a role (as opposed to haphazardly illuminating something), those roles are different and separate (just as primary and secondary lighting fixtures discussed herein different and separate). Aspects according to the present invention provide for methods of enhancing primary lighting with secondary lighting and vice versa to provide for further or more impactful theatrical effects, but it is important to note that this does not change the primary role of either type of fixture or lighting and that reference to a primarily LED lighting fixture makes reference to an LED lighting fixture that primarily lights a target area (even if contributing to a theatrical effect).

Further regarding terminology, reference is given herein to poletop fixtures, as well as poletop mounting positions. It is important to note that because of limitations in wiring, the need for low EPA, and general pole construction, it is virtually infeasible to mount one or more lighting fixtures at the literal top of a pole. The term "poletop" is well understood in the industry to include the space at or near the top of the pole where lighting fixtures, crossarms, armatures, brackets, pole caps, and pole fitters reside. Therefore, a first array of LED lighting fixtures on a top crossarm are equally considered poletop fixtures as compared to a second array of LED lighting fixtures on a bottom crossarm some number of inches or feet lower on the same pole. Alternatively, it will be appreciated from the illustrations set forth that secondary lighting fixtures according to aspects of the present invention are not at a poletop position; most often they are installed just above an electrical enclosure out of reach of the average person (so to prevent theft or vandalism) at a height of roughly ten feet, though this could differ and not depart from aspects according to the present invention.

Further regarding terminology, reference is given herein to illumination, lit, lighting, and the like—all such terms are used generically to describe the visually perceivable emission of one or more light sources. Unless explicitly stated herein, none of the aforementioned terms are intended to purport a particular luminance, illumination, color point, color temperature, spectral distribution, reflection type, transmission efficiency, or the like; all are possible and envisioned. For example, reference is given herein to a commercially available RGB-type lighting fixture to provide theatrical effects in accordance with aspects of the present invention. However, there may be instances where a sports team, as an example, desires a particular color to appear on every other pole in an outfield during a team walk-on, and said color necessitates adding one or more amber LEDs to the RGB-type fixture so to effectuate the desired perceived color. It is not necessary to know the exact color point, color temperature, spectral distribution, or the like of the resulting RGBA secondary lighting fixture to practice the present invention, and such things as adding an amber LED to an RGB-type fixture so to facilitate an enhanced spectator experience is certainly contemplated by the embodiments set forth.

Base Lighting System

Figure 3:
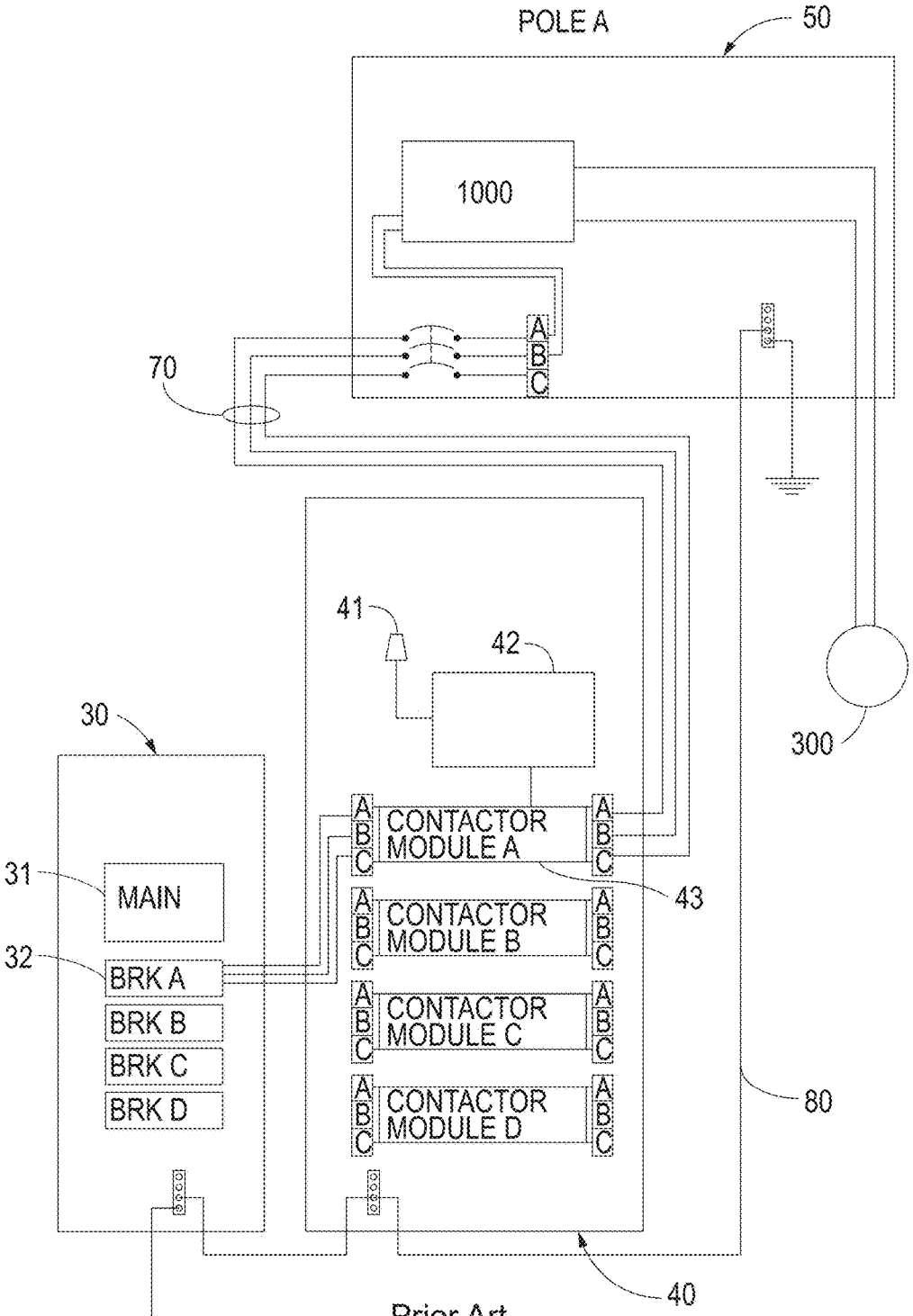
Prior Art Figure 3
Figure 4:
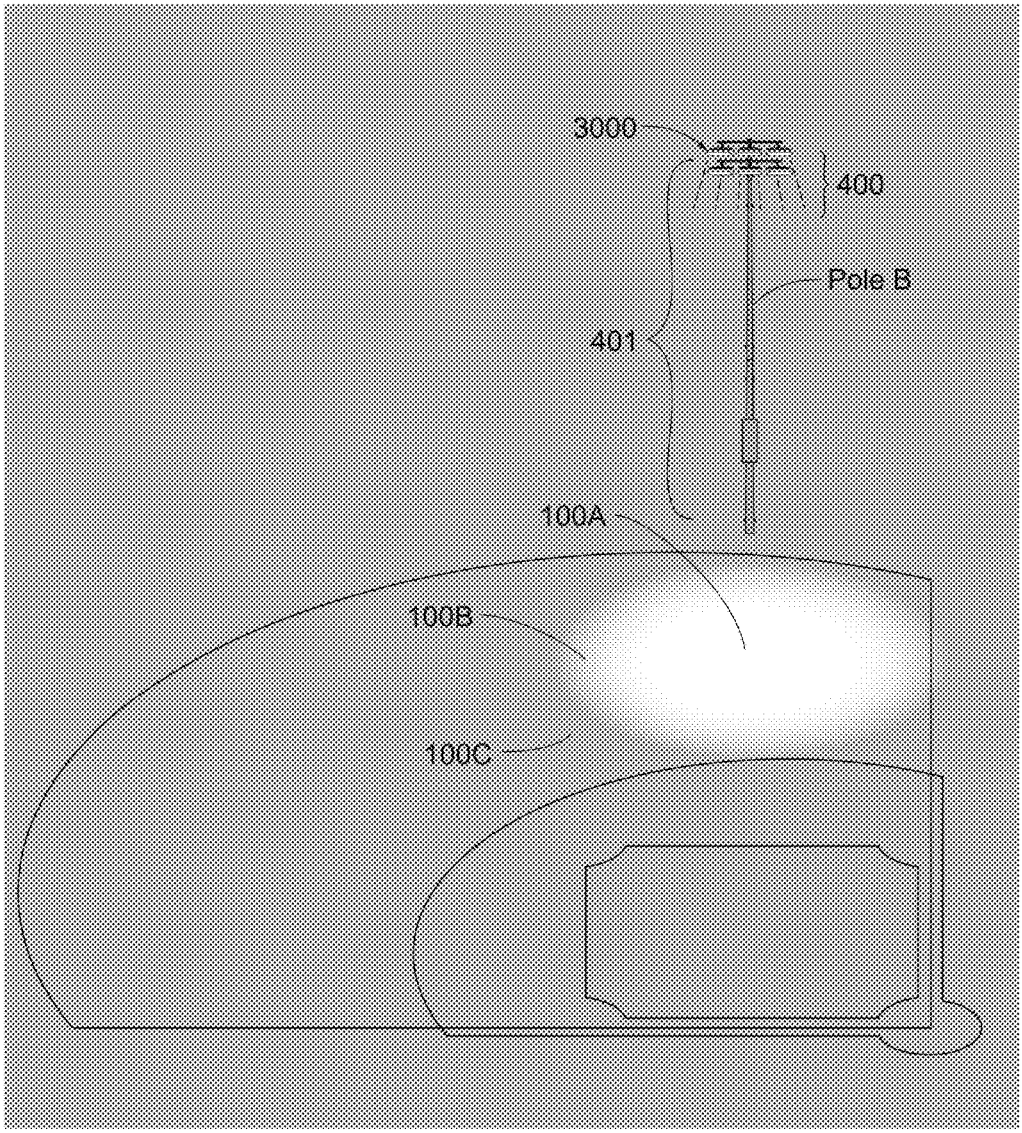
Prior Art Figure 4
Figure 5:
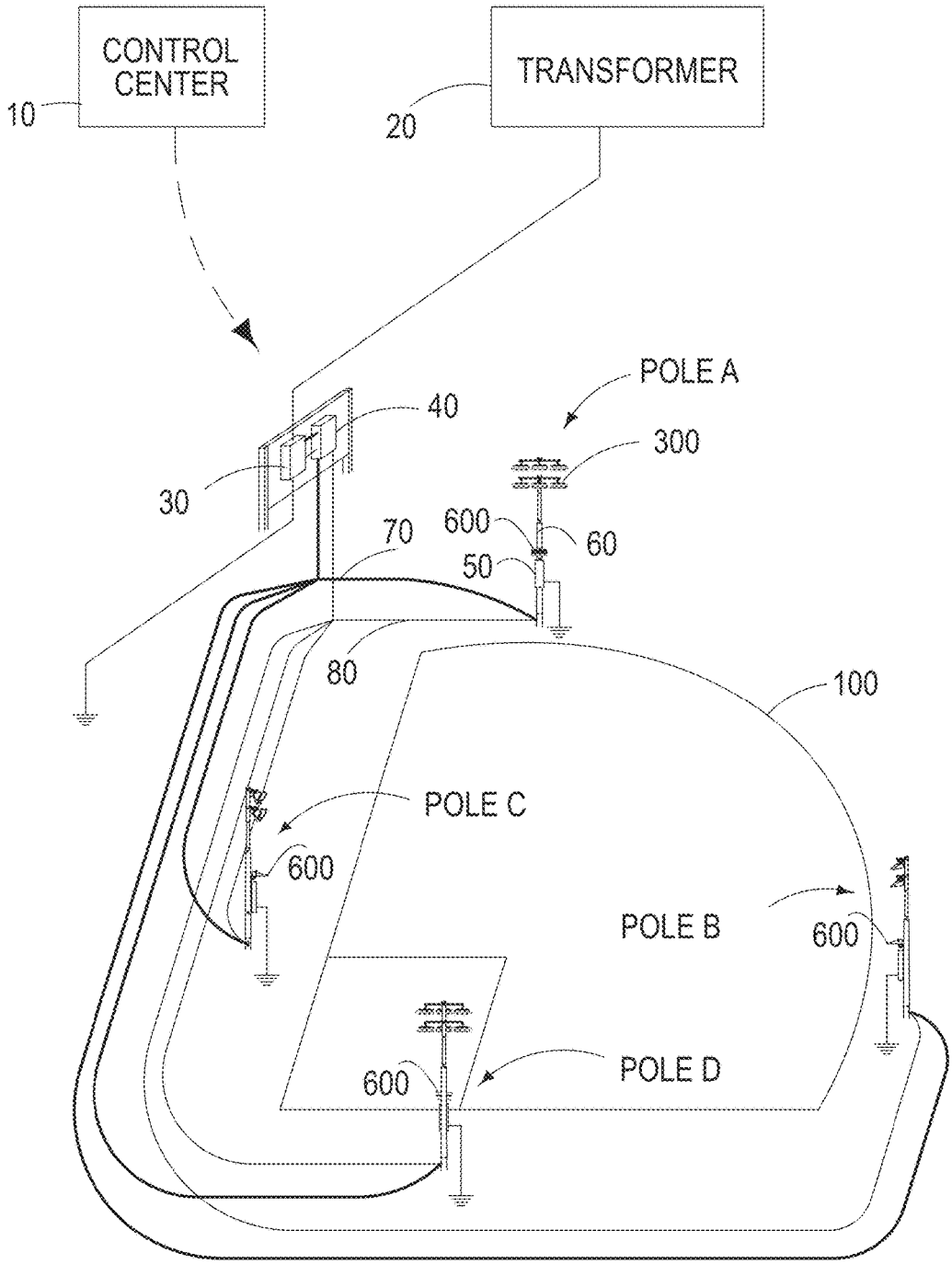
Figure 6A:
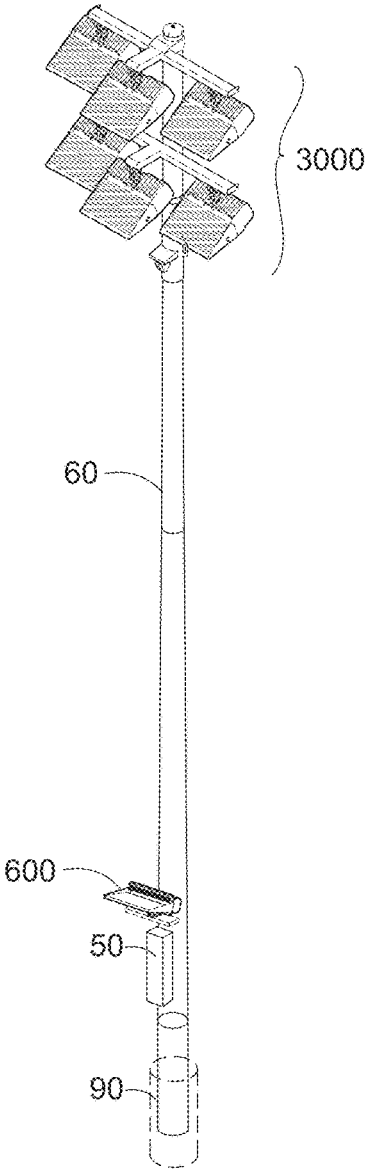
Figure 6B:
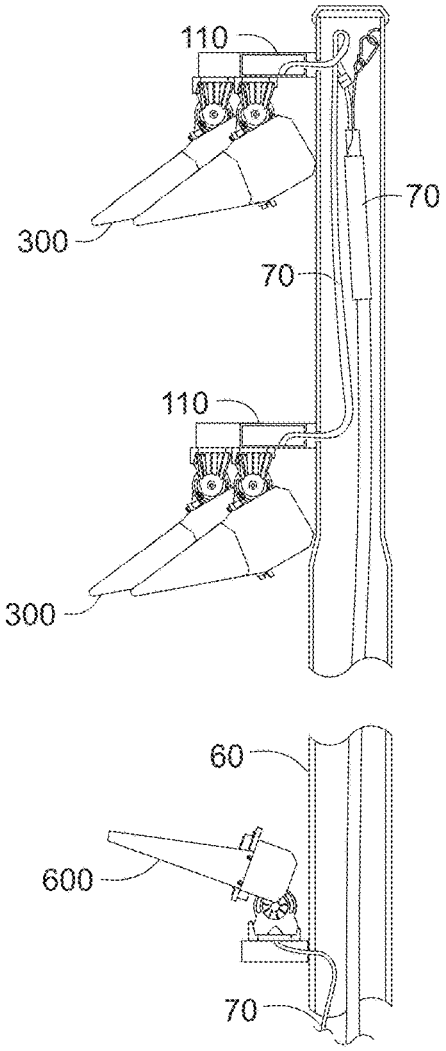
Figure 6C:
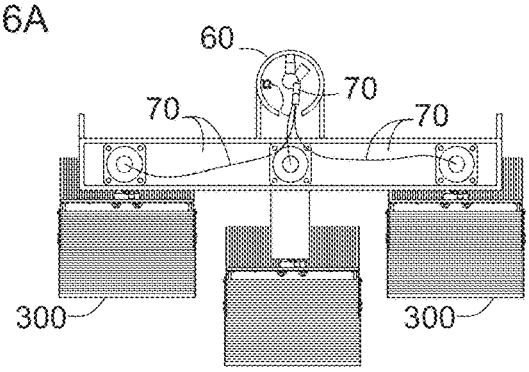

While aspects of the present invention could apply to any lighting application where there is a need to provide primary lighting during nighttime or low ambient light conditions, and which may also benefit from secondary lighting for theatrical effects, sporting events are perhaps one of the most well known. As such, specific embodiments are set forth using a relatively simple four-pole baseball field sports lighting system for context; though, of course, this could differ and not depart from aspects according to the present invention. FIG. 1 illustrates an overview of said sports lighting system; here the target area comprises not only field 100, but the aerial space above field 100 (e.g., so to illuminate a ball in flight). Generally speaking, incoming power is delivered to the site by a transformer 20 which is metered out at a distribution cabinet 30, local operation of said power is facilitated at a control cabinet 40, and power is distributed via underground power lines 70 in conduit where it is conditioned for the load (i.e., primary LED lighting fixtures 300) at each pole 60 at a pole cabinet 50. Almost all sports lighting systems require or benefit from equipment grounding and/or GFCI-type functionality, and so grounding wires 80 are distributed in a similar fashion as power lines 70 (albeit in a separate conduit) and generally positioned as can be seen in FIG. 3; additional background information regarding ground monitoring, leakage current, and GFCI for high voltage systems can be found in U.S. Pat. Nos. 8,537,516, 8,605,394, and 8,614,869 all of which are incorporated by reference herein in their entirety.

Figure 2A:
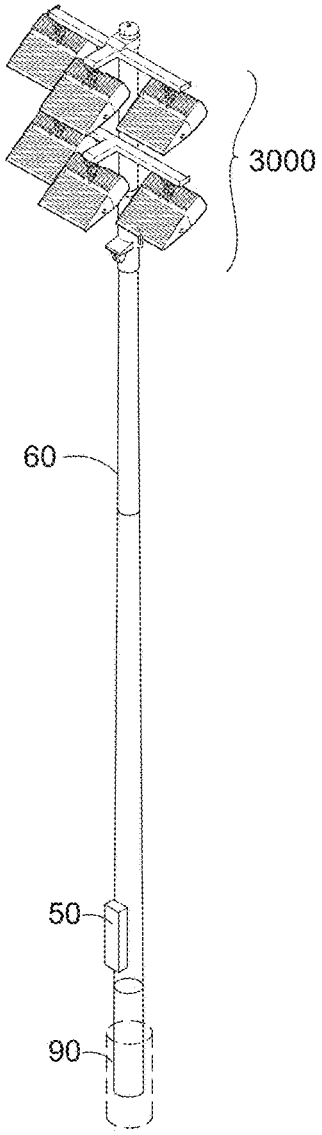
Figure 2B:
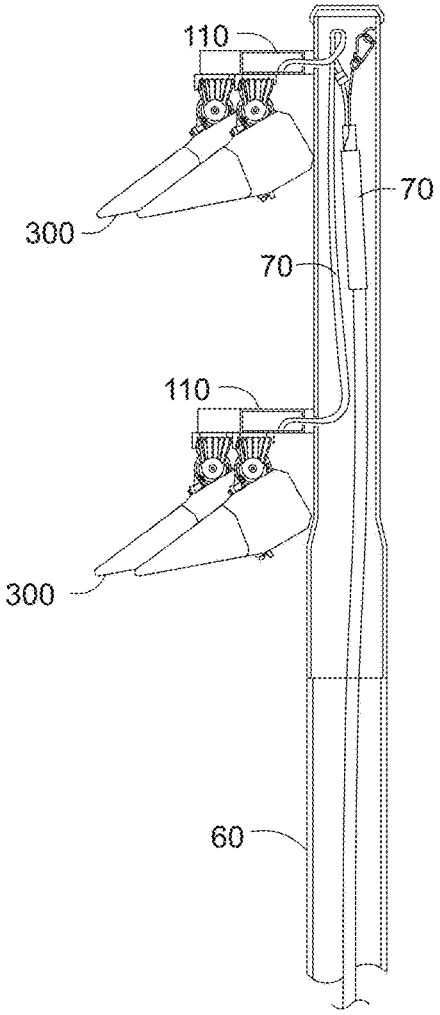
Figure 2C:
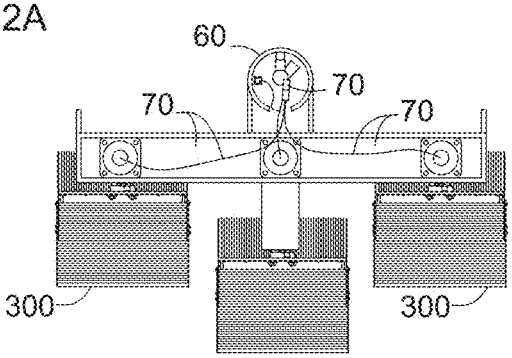
Prior Art Figure 2C

At a fixture level (FIGS. 2A-C) power that has been metered, distributed, and conditioned for the load is run from pole cabinet 50 up the interior of a substantially hollow pole 60 set in a concrete foundation 90 or otherwise positionally affixed, through a substantially hollow crossarm 110, through a substantially hollow armature (which may be static or adjustable, as is later discussed), and into each LED lighting fixture 300 in an array of LED lighting fixtures 3000 designed to provide primary lighting to said target area; additional background information regarding cabinet, pole, crossarm, and knuckle design to facilitate the internal routing of wiring (e.g., to protect against moisture) can be found in U.S. Pat. Nos. 4,190,881, 5,600,537, 8,337,058 and U.S. patent application Ser. No. 12/910,443 all of which are incorporated by reference herein in their entirety.

Figure 16:
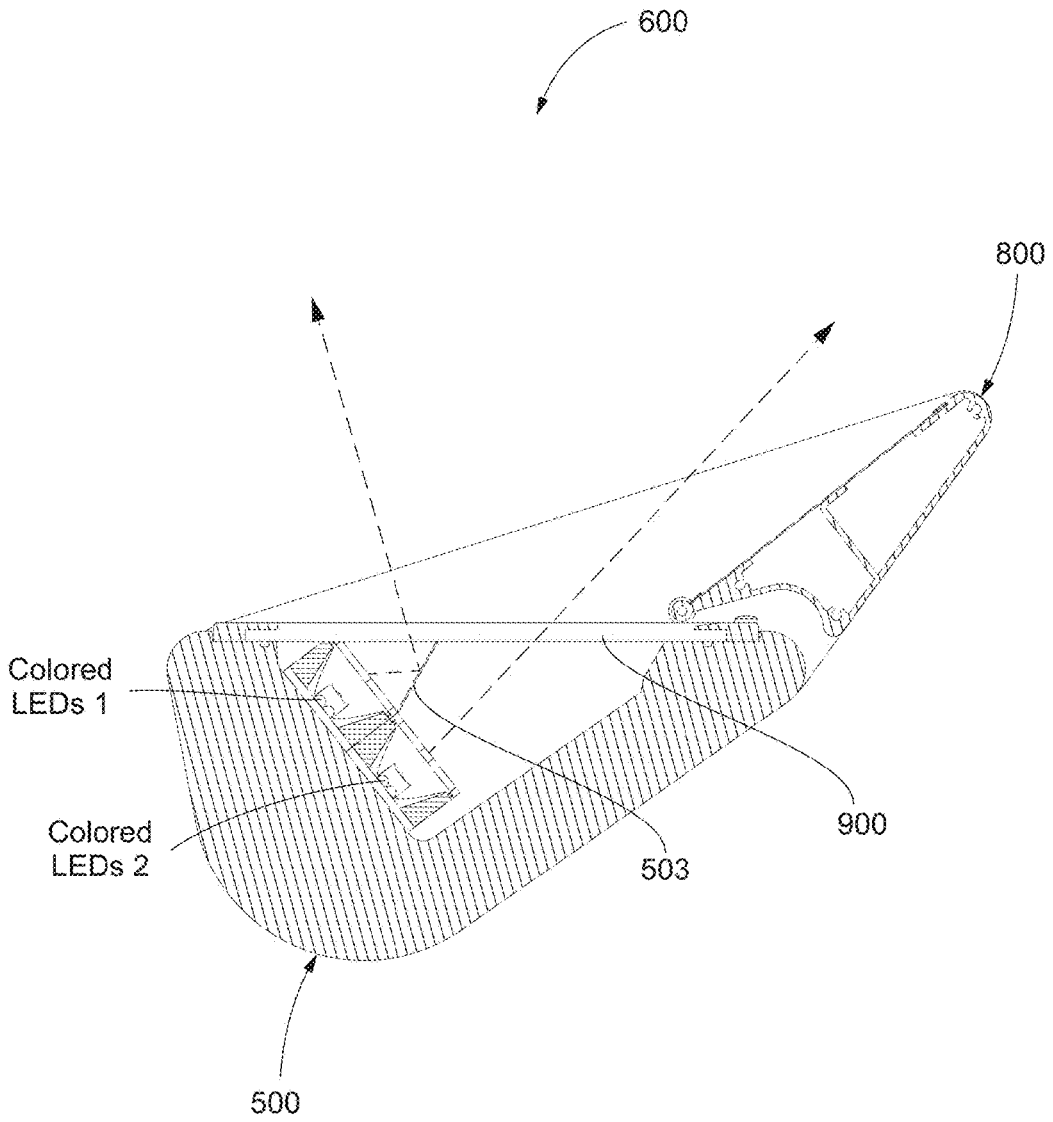
FIG. 16 illustrates a typical section view of the LED lighting fixture of FIGS. 8A-G as modified with a reflective device so to produce a split beam to effectuate the theatrical effect on the middle pole of FIG. 12; note that for clarity hatching has been omitted for light transmissive device 900.

Fixture 300 may be of a variety of shapes, sizes, efficiencies, and the like, but for purposes of providing primary lighting which could adequately illuminate the target area of FIG. 1 in a manner that does not interfere with players' lines of sight such that they perceive glare, it is generally desirable to use LED lighting fixtures with independently adjustable cutoff or otherwise enhanced glare control such as is described in U.S. Pat. Nos. 8,789,967 and 9,631,795 both of which are incorporated by reference herein in their entirety. As such, specific embodiments are set forth using the general LED lighting fixture of FIGS. 8A-G which include features of the aforementioned incorporated patents. For purposes of the base LED sports lighting system, primary lighting fixture 300 includes a thermally conductive housing 500 to which an independently adjustable visoring system 800 is affixed, and an adjustable armature 200 which affixes housing 500 and visoring system 800 to a crossarm (not illustrated). Housing 500 includes a number of thermally conductive heat fins 501 so to permit rapid removal of heat from LEDs contained in an opening to housing 500, said opening sealed by a light transmissive device 900 such that the composite light emitted from the LEDs contained in housing 500 emits towards field 100 through device 900 and heat is transferred away from said LEDs in a generally opposite direction out the non-emitting face of the LEDs, out heat fins 501, and away from housing 500; FIG. 16 and the aforementioned incorporated patents illustrate relative orientation of LEDs within a thermally conductive housing and relative a light transmissive device. Visoring system 800 generally includes a rigid or semi-rigid surface 801 (e.g., to protect against balls in flight and wind) to which a reflective surface 803 is attached, and rigid or semi-rigid side surfaces 804 which provide for connection means 805 to allow pivoting of reflective surface 803 into and out of the composite light emitted through device 900 so to effectuate beam redirection and cutoff. Adjustable armature 200 permits pivoting of housing 500 and visoring system 800 left and right (also referred to as panning or horizontal aiming) about pivot axis 2000, as well as pivoting of housing 500 and visoring system 800 up and down (also referred to as tilting or vertical aiming) about pivot axis 4000. Each primary LED lighting fixture 300 in an array 3000 could have a unique visor, horizontal, and vertical angle setting, if desired. Or, if cost is a primary driving factor, armatures may simply be static (i.e., non-adjustable), hollow tubes, and primary lighting fixtures may not have independently pivotable visors. If so, there may be more onsite glare than desirable, but in any event the result is (i) a full length of darkened pole 401 which is not visible to spectators, and (ii) a composite beam 400 which illuminates some portion of the target area, the composite beam having a size, shape, and intensity such that some portion of the target area 100A is fully illuminated, some portion of the target area 100B is less illuminated, and some portion of the target area 100C receives no contribution from that particular beam 400. In this sense the composite beams from each pole are overlaid and strategically placed on field 100 such that a lighting design of sufficient light levels, uniformity, etc. is "built up" from individual composite beam patterns—this practice is also discussed in the aforementioned incorporated patents.

From an operational perspective, a base LED sports lighting system such as that illustrated in FIGS. 1-4 and 8A-G could simply be manually operated via, e.g., on/off switches at control cabinet 40 (so to terminate power at contactor module 43) or distribution cabinet 30 (so to terminate power at main 31 or breaker A 32). However, it is often desirable to provide remote control functionality as it can be very inconvenient to walk or drive to a sports field to turn lights on and off; and given that often it is park and recreation personnel who must turn the lights on and off, and given that there are often several sports fields to which persons are assigned, manual control as the sole operating mechanism can result in excessive manpower costs. So often said personnel will be in communication with a remotely located control center 10 to enable immediate on/off (e.g., by phoning in, by logging into a website), scheduling (e.g., by uploading a weeks' worth of on/off schedules into said website), so-called early offs or late games (where a game ends early or late, respectively), and the like. At a functional level, remote control can be effectuated by wireless communication from control center 10 to an antenna or receiver 41 located in control cabinet 40 which is in communication with a control module 42. Communication means could comprise satellite, radio, IR, cellular, or the like, and control module 42 operates contactors 43 according to the communicated schedule or command. For LED lighting (which can be dimmed significantly without adverse effect), dimming profiles could be communicated in a similar fashion (e.g., communicated via powerline from control module 42 to driver 1000) in response to a communicated schedule or command. Additional background regarding remote operation of sports lighting systems can be found in U.S. Pat. Nos. 6,681,110, 7,209,958, 7,778,635, and 9,026,104 all of which are incorporated by reference herein in their entirety.

Specific Embodiments

Set forth are apparatus and methods for providing secondary lighting of a particular size, shape, intensity, and/or color on a surface other than the surface or area being primarily lit (i.e., the target area) so to provide theatrical effects in a manner that does not interfere with the primary lighting. In the context of the base LED lighting system just described, one method includes mounting secondary lighting fixtures to the same poles 60 as the primary lighting fixtures 300, but at a position other than poletop. Secondary lighting fixtures could be of a same or similar construction to that illustrated in FIGS. 8A-G but having colored LEDs instead of perceivably white LEDs, or otherwise including a color gel on device 900 so to emit perceivably colored light; however, alternative secondary lighting fixtures are also set forth in the following discussion.

Power for said secondary LED lighting fixtures can be metered, distributed, and conditioned in a similar fashion to that described for primary LED lighting fixtures 300, but alternatives are also set forth in the following discussion. Secondary lighting fixtures are mounted and aimed so to project light onto the poles instead of field 100 or the aerial space above the field. In this manner a spectator's eyes are purposefully directed away from the target area and towards the pole during theatrical effect triggers such as those already discussed, and because the spectators eyes are directed to a length of pole below and proximate the primary lighting fixtures, there is an opportunity to highlight or enhance the primary lighting by coordinating theatrical effects between the secondary lighting and primary lighting. Further, because some small subset of primary lighting fixture LEDs are likely viewable when spectators look directly at said primary fixture (as this is an uncommon sight line and so is not typically designed around for purposes of glare mitigation), and because LEDs have a small source size, and because there is a high contrast at this viewing angle, small changes to dimming, duty cycle, or other operational characteristics can yield a more dramatic theatrical effect than if the same change was made while a spectator was looking at the target area. For example, pulsing current in primary lighting fixture LEDs a fraction of an amp for theatrical effect can be perceived by a spectator looking directly at the primary lighting fixture set against a dark sky, but would not likely be perceived by that same spectator looking at the field (e.g., due to a lack of contrast against the brightly lit field in combination with the Inverse Square Law).

Specific embodiments include accompanying apparatus such as user interfaces, power wiring, and communication means to enable a user—onsite or remotely—to program secondary, primary, or both secondary and primary lighting fixtures so to produce theatrical effects. Details of all of the aforementioned are set forth in the following discussion.

B. Exemplary Method and Apparatus Embodiment 1

FIGS. 5-7C illustrate the four-pole baseball field sports lighting system from FIGS. 1-3 (i.e., the base LED lighting system) as modified according to the present embodiment. As can be seen from FIG. 5, at an overview level power and ground wiring do not differ from the base LED lighting system when installing a secondary LED lighting fixture 600 at each pole 60 to provide theatrical effects via targeted lighting of said pole. In practice, installation of fixture 600 is similar to that of installation of fixture 300, the mechanics of which are discussed in the aforementioned patents. As can be seen from FIGS. 6A-C, both primary and secondary lighting fixtures (300 and 600, respectively) receive metered, distributed, and conditioned power via power lines 70 which are routed internally through pole 60, crossarms 110, and armatures (e.g., adjustable armature 200); however, the exact apparatus in cabinets 40 and 50 depends on communication means, desired control options, and operating characteristics of secondary lighting fixtures 600.

Figure 7A:
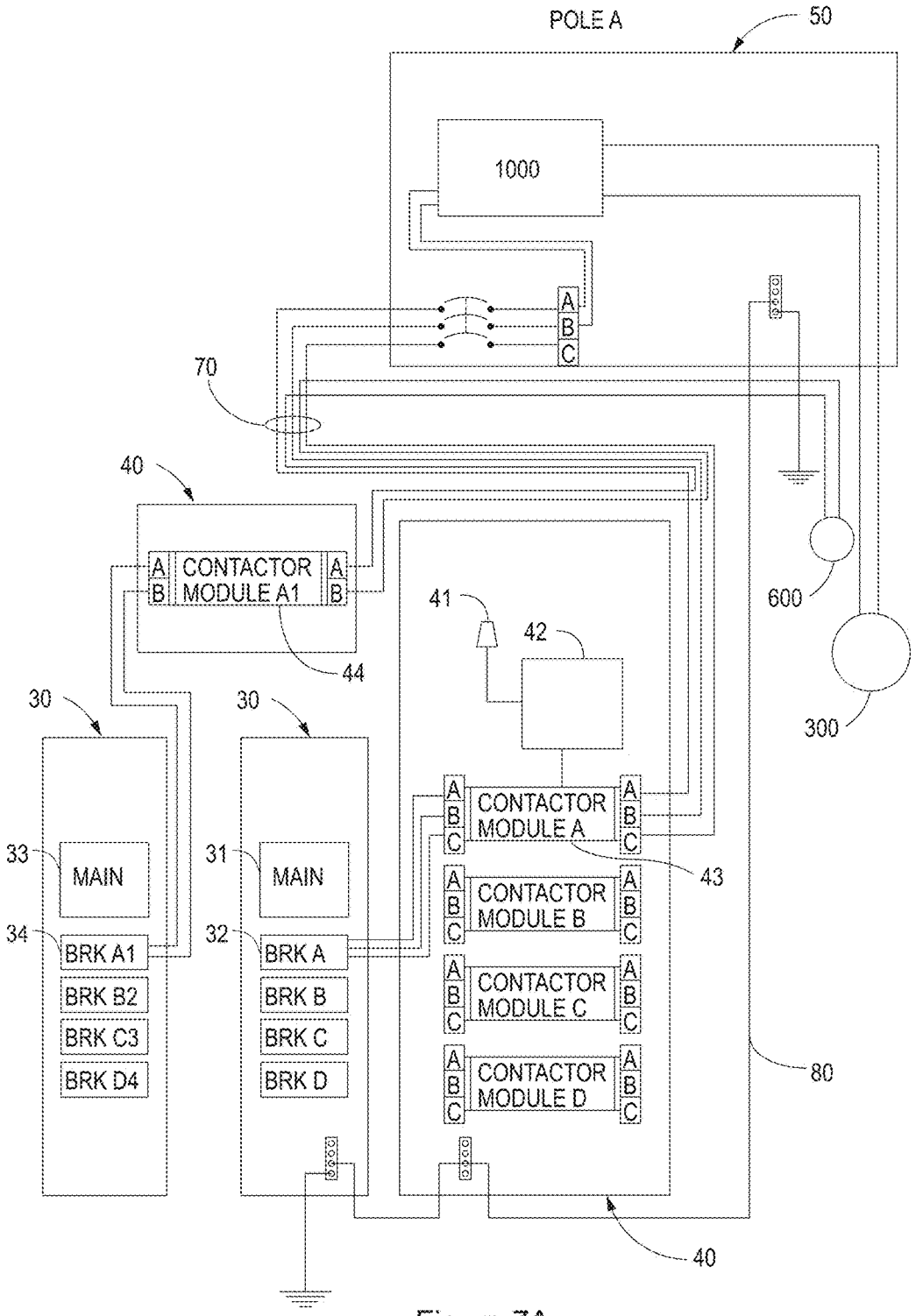
Figure 7B:
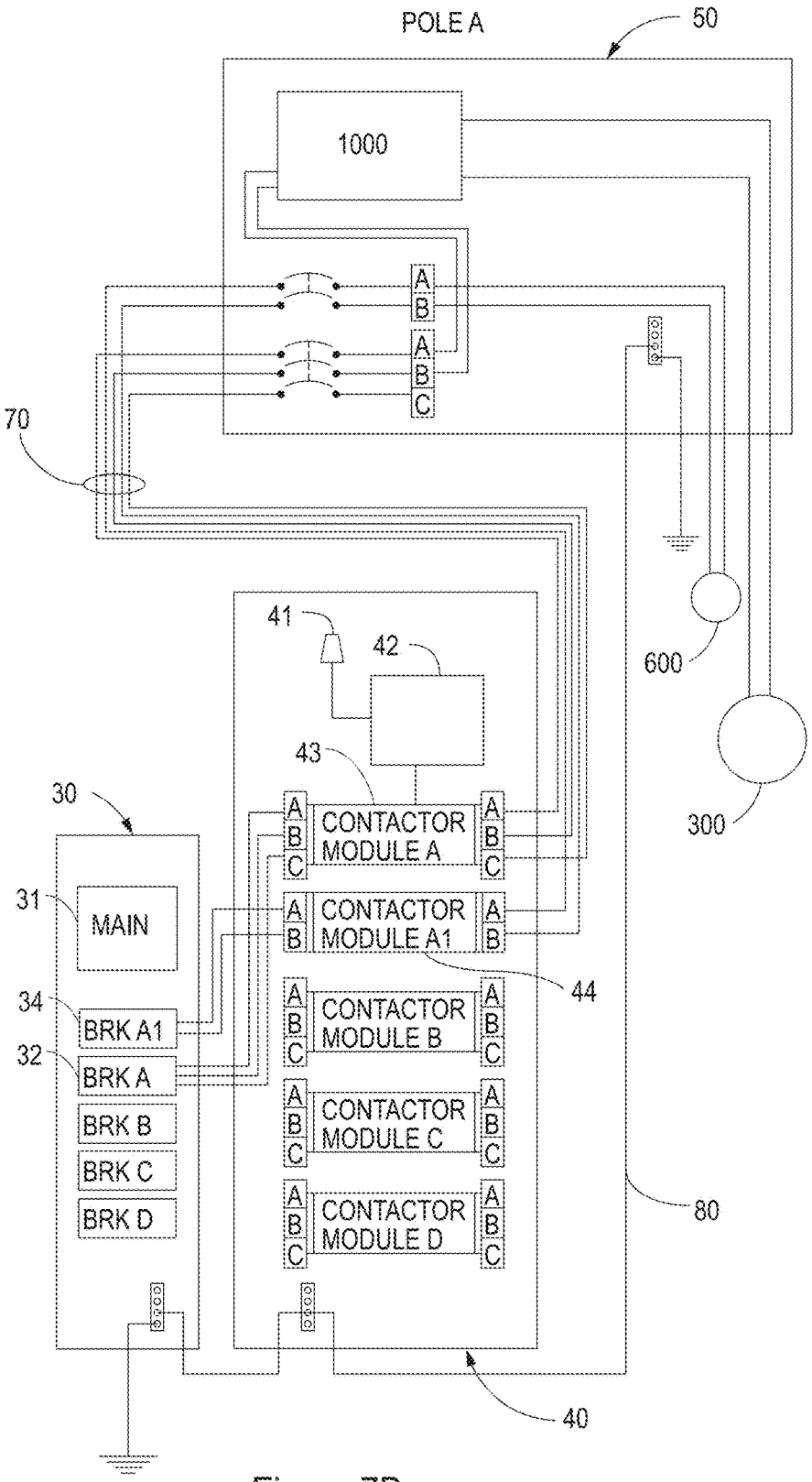
Figure 7C:
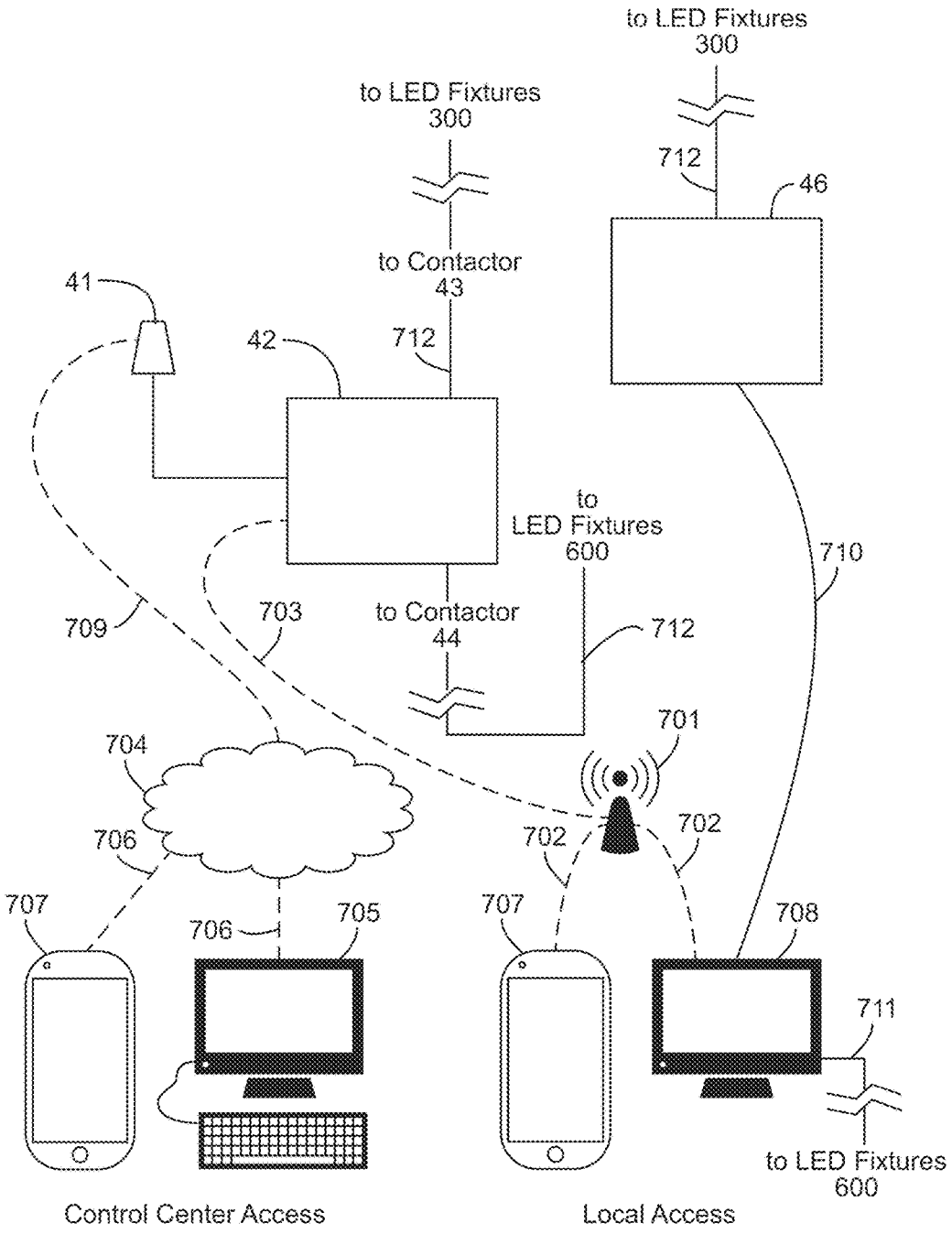
Figure 8A:
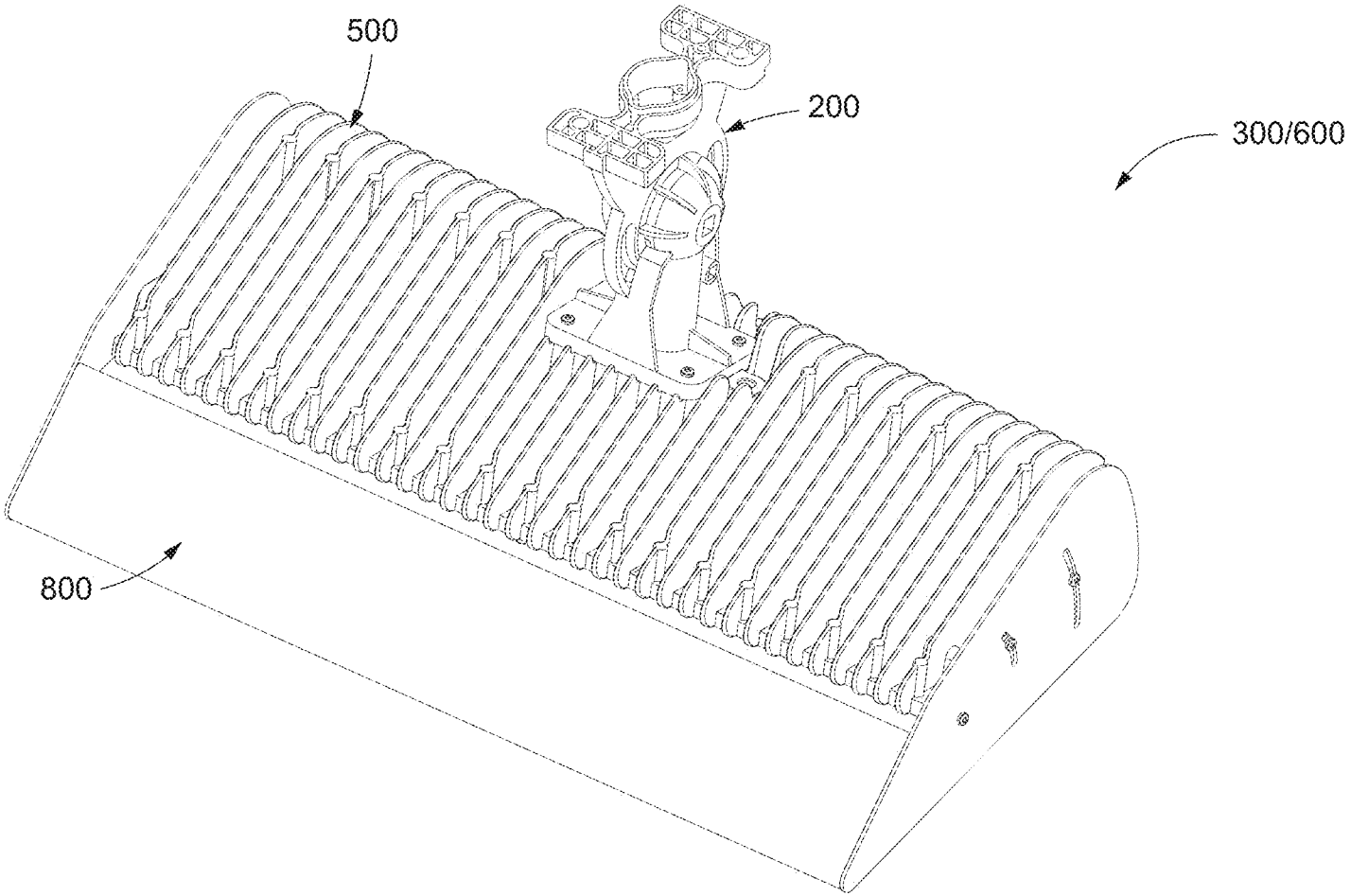
Figure 8B:
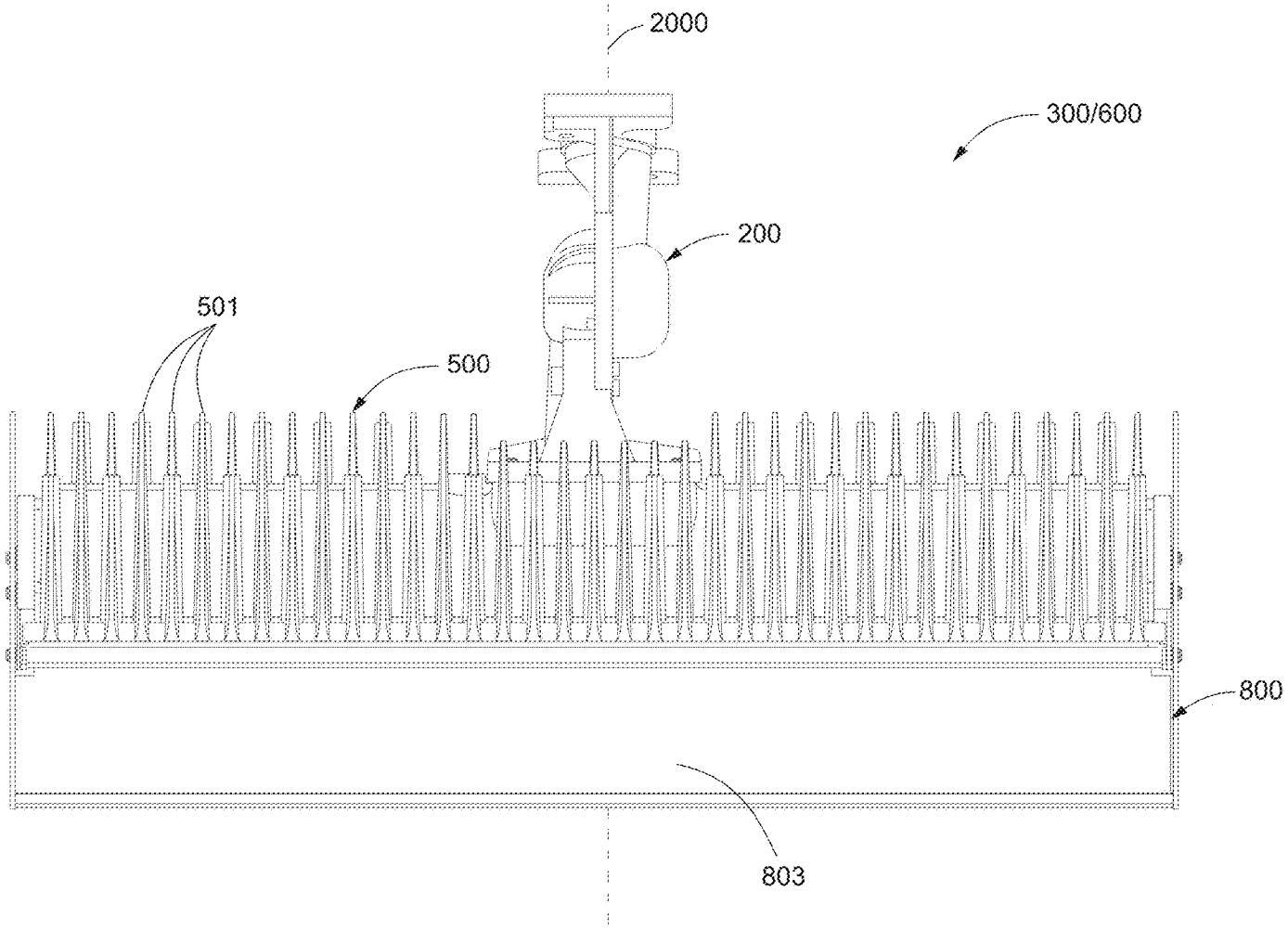
Figure 8C:
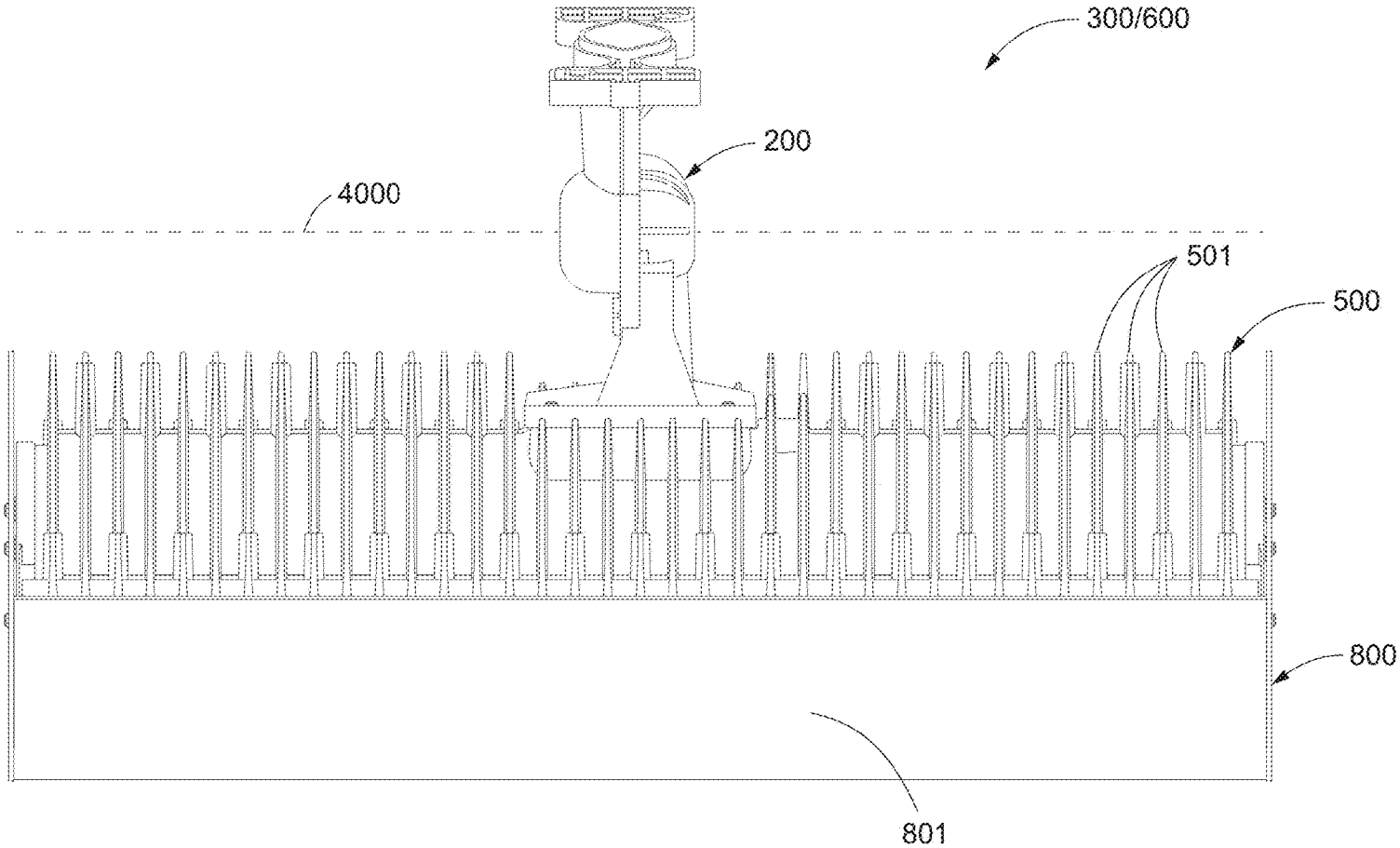
Figure 8D:
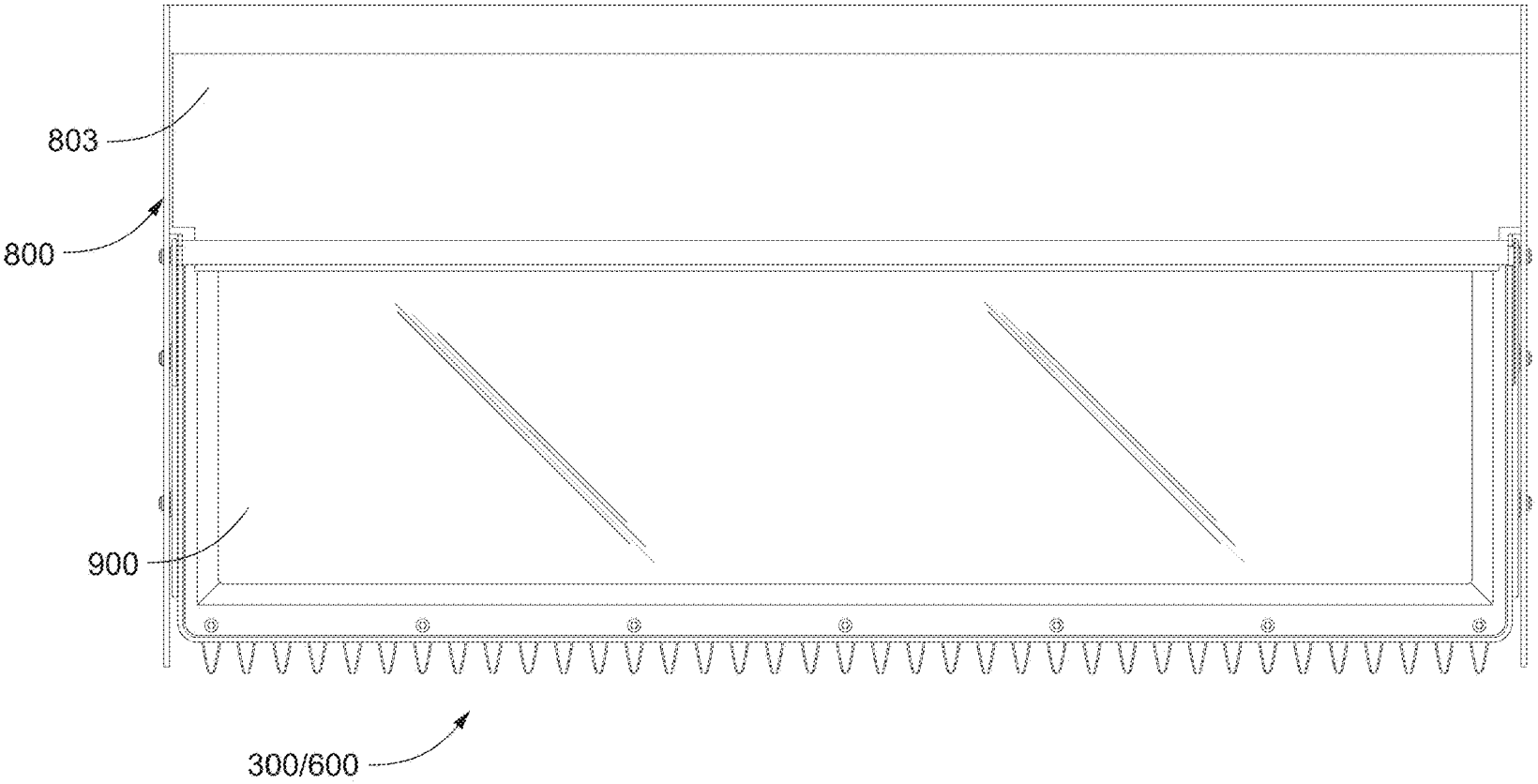
Figure 8E:
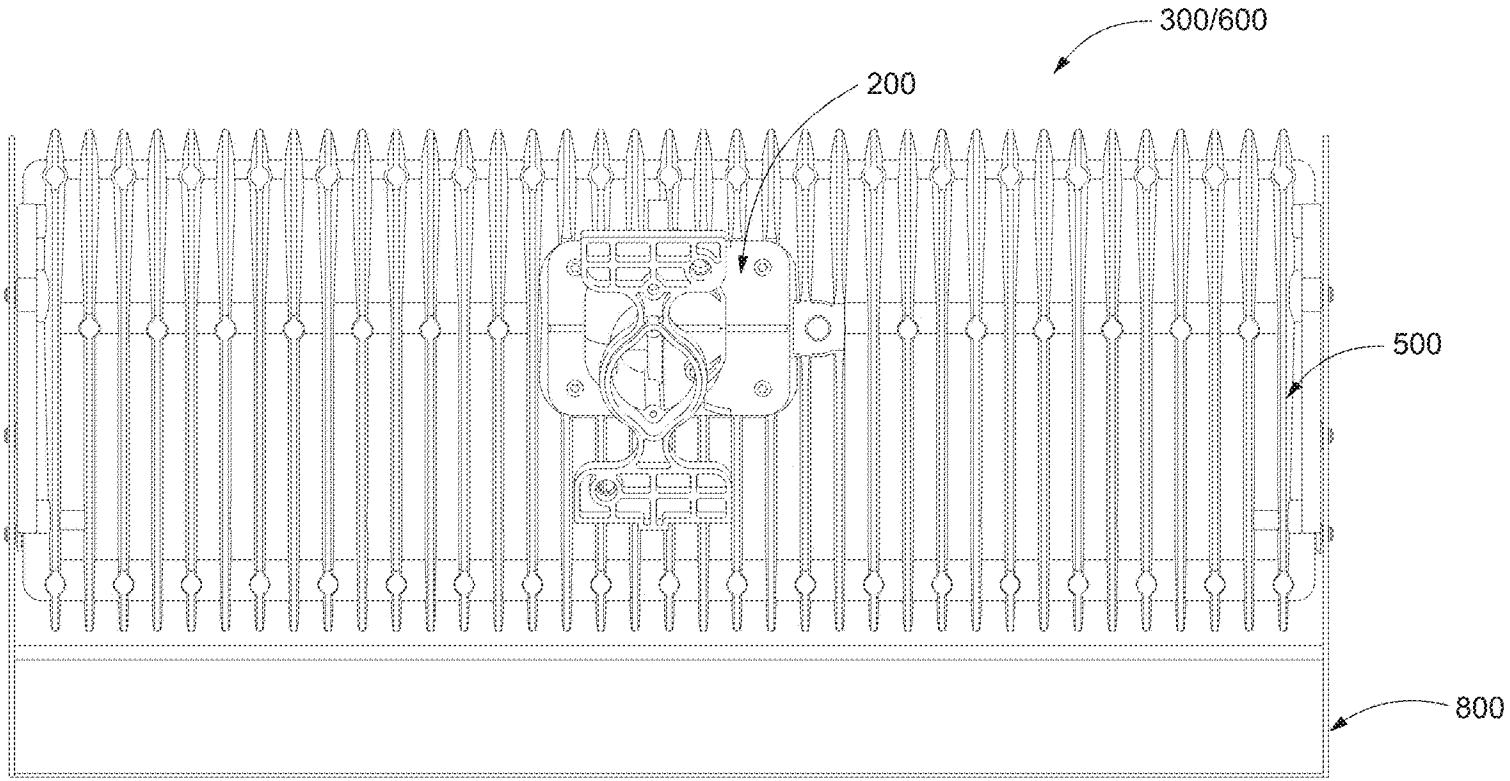
Figure 8F:
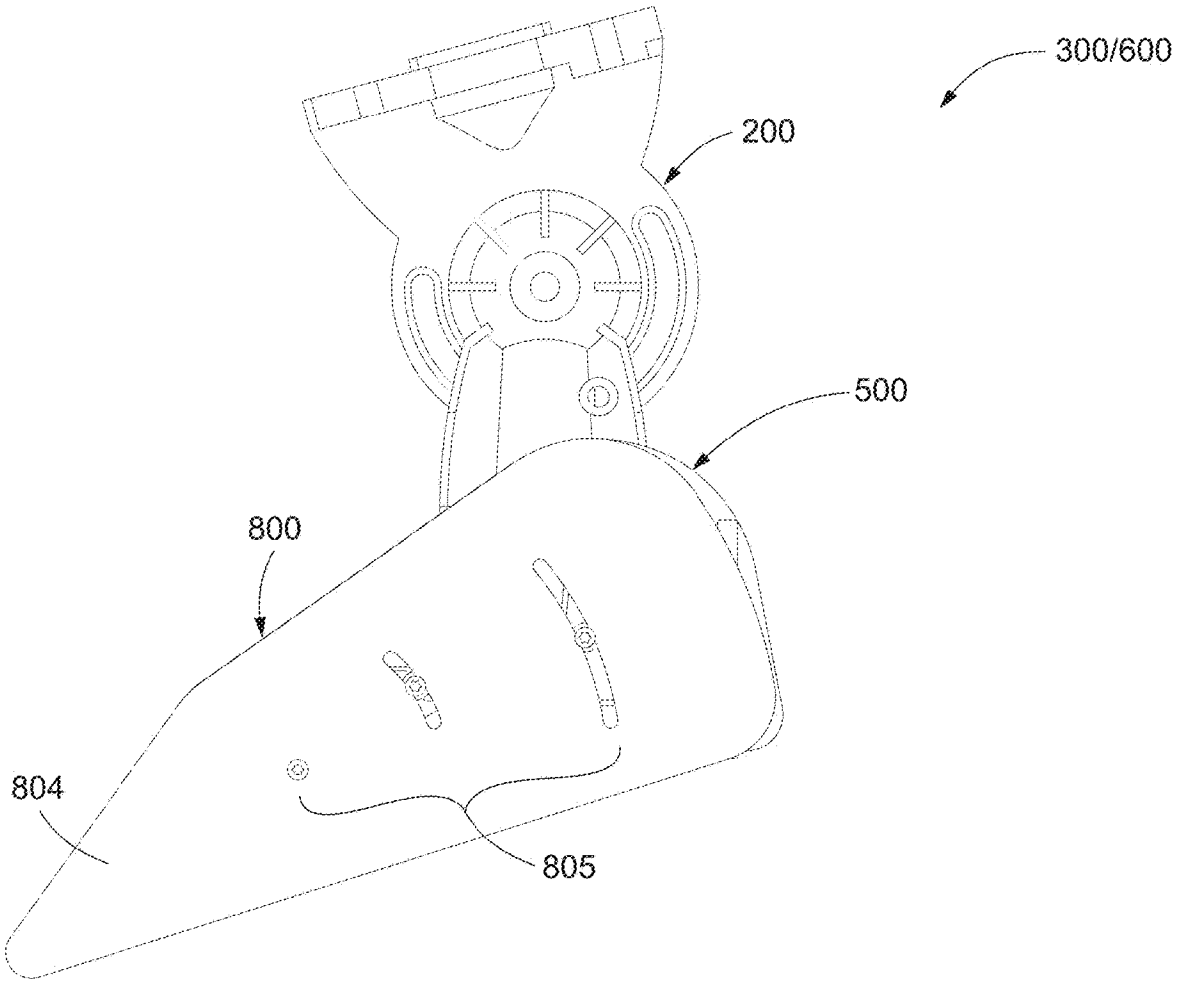
Figure 8G:
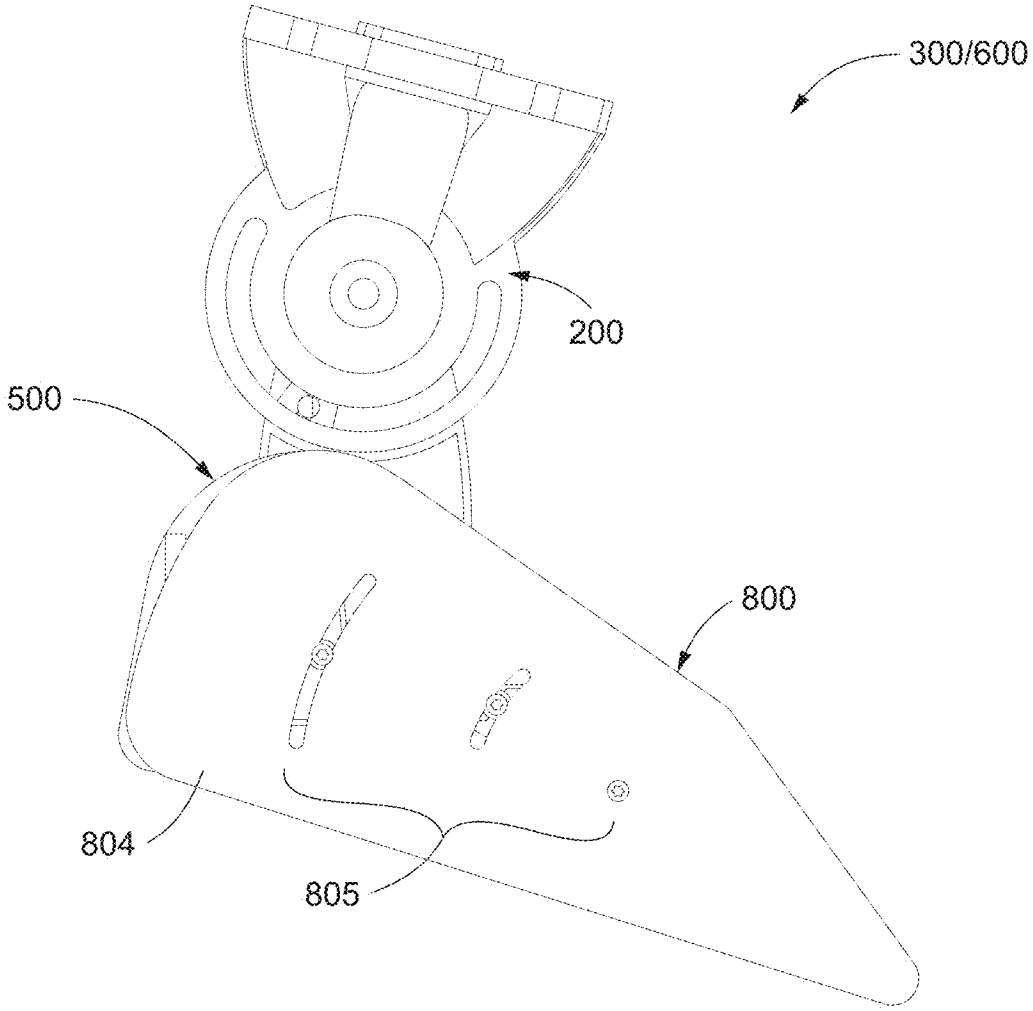

FIG. 7A illustrates a first partial wiring diagram in which secondary LED lighting fixture 600 at Pole A differs significantly in operating requirements from primary LED lighting fixtures 300 at Pole A. Here secondary LED lighting fixture 600 is a commercially available 100 W RGB-type LED fixture with an onboard driver and integrated DMX controls (which is a standard lighting control protocol for rapid control of LEDs for theatrical effects); specifically, model LiveLED 100 formerly available from Advanced Lighting Systems, Inc. (acquired by Nexxus Lighting, Charlotte, N.C., USA). There are advantages to using lower rated operating wattage (~1400 lumens at 1 A) secondary LED lighting fixtures. Firstly, they are often lightweight; the LiveLED 100 model weighs approximately 13 lbs. They are often preloaded with lighting effects such as fades, color changes, strobes, etc., and some are suitable for outdoor use. However, they sometimes have subpar connection means (e.g., plastic, fragile, or unsuitable for hot environment yoke-style armatures). Also, low wattage LED lighting fixtures used in secondary lighting typically do not have the same operating requirements as primary LED lighting fixtures. Often site power delivered to control cabinet 40 is three-phase, 480 V (which is very common for sports venues in the United States), and secondary LED lighting fixtures such as the LiveLED 100 model typically require two-phase, 85-265 V. As such, power wiring may require an additional distribution cabinet 30 with its own dedicated main 33 and breaker 34, as well as its own control cabinet 40 with dedicated contactor module 44 for onsite on/off manual control; additional remote (also referred to as offsite or control center) control and onsite (also referred to as local) control is later discussed. Alternatively, if secondary LED lighting fixtures 600 are designed to work with three-phase, 480 V (as in FIGS. 8A-G) or site power is 220, 230, or 240 V (which is possible), power wiring may be such as is illustrated in FIG. 7B. In this alternative configuration one need not incur the cost of extra cabinets, but contactors for module 44 will likely be much larger (and therefore more expensive). Either option is feasible according to aspects of the present invention.

With respect to operation, onsite manual control and remote center control enabled in the base lighting system for primary LED lighting fixtures 300 could also be used for secondary LED lighting fixtures 600 if, for example, contactor module 44 is in communication with control module 42 and fixtures 300 and 600 operate on the same protocol (for the case of the LiveLED 100 model fixture, DMX control). If not, control may need to be modified from that of the base lighting system to include a gateway 46 to align or otherwise convert communication protocols. Gateways (such as are available from Electronic Theatre Controls, Inc., Middleton, Wis., USA) are well known devices in the art of lighting control, as are nodes and control consoles (also available from Electronic Theatre Controls, Inc). If desired, control may be further modified to include a local web server so to offer a host of onsite and offsite control options (at rapid response rates). All of the aforementioned are possible, and illustrated in FIG. 7C, and it is important to note all of the aforementioned are possible irrespective of whether drivers 1000 are integral to the lighting fixtures (primary or secondary), or are separate devices interposing the control means in FIG. 7C and the corresponding LED fixtures (primary or secondary).

Figure 13:
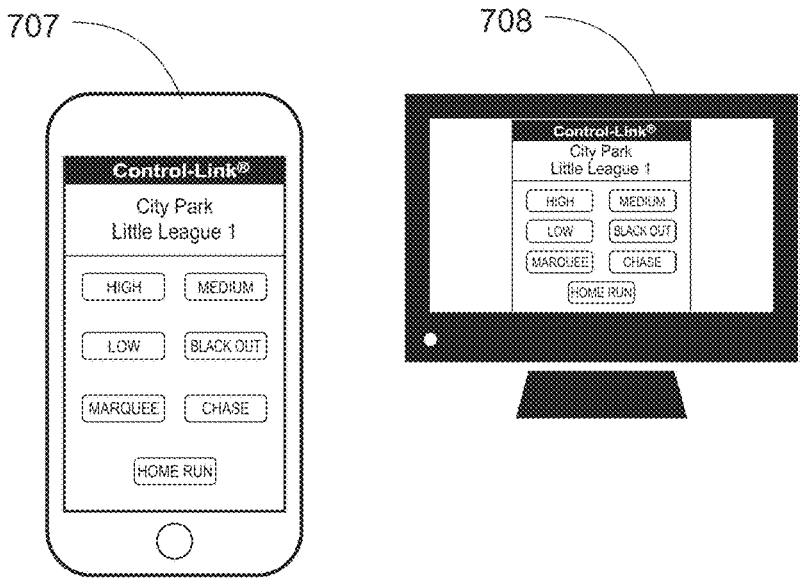
FIG. 13 illustrates various possible user interfaces for programming the theatrical effects of FIGS. 9-12 according to aspects of the present invention.
Figure 13:
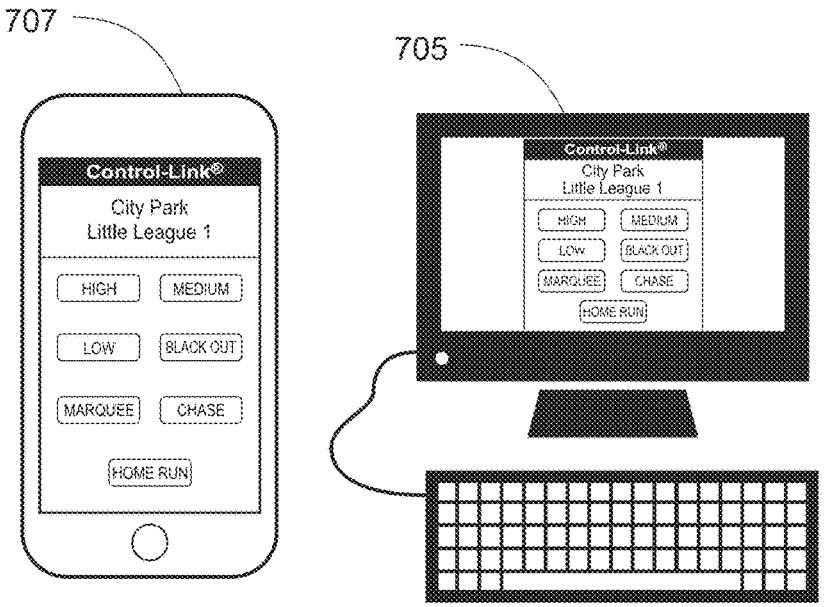

By way of further discussion, local or onsite control could be provided by traditional on/off switches, but this is impractical for theatrical effects. It is more likely that a central touchpad device 708 would be used (e.g., in press boxes)—particularly for secondary LED lighting fixtures 600 with preloaded effects or integral DMX controllers. Connection from a touchpad device 708 to commercially available secondary LED lighting fixtures 600 will likely be a copper line 711, but for outdoor sports venues a media converter (not illustrated) for converting copper to fiber optic will likely be needed. Connection 710 to primary LED lighting fixtures 300 could also be copper or fiber optic, but if the base LED lighting system is already enabled with an antenna or receiver 41 and control module 42, it may be equally desirable enable control module 42 with said local web server and wirelessly connect 702 touchpad 708 to control module 42 via wireless connection 703 to a wireless access point 701; again, much of this depends on the communication protocol inherent to fixtures 300 and 600. The latter approach also allows for access and control from a smartphone-type device 707, which permits a user to walk around the target area and evaluate theatrical effects from various vantage points. Remote control can be effectuated from a mobile or traditionally immobile device (smartphone-type device 707 or desktop 705, respectively) which wirelessly communicates 706 to a cellular, radio, satellite or other network 704 which in turn is in wireless communication 709 with said antenna or receiver 41. As discussed in the aforementioned patents, antenna or receiver 41 could be bi-directional and enable feedback of status, current measurements, alarms, etc. back to remote control center 10 for purposes of reporting, trending, or diagnostics, for example. Communication from control module 42 to both primary and secondary LED lighting fixtures could be via powerline or other wired connection 712, or could be wireless; again, much of this depends on the communication protocol inherent to fixtures 300 and 600. For example, powerline communication may be preferable because there may be a high risk of interference when doubling up on wireless communications—or there may simply not be a line-of-sight option (which can impact some wireless communication means). As stated, various permutations of the aforementioned are possible, and envisioned, and in any event, a user could be presented with the same options from the same secure login or portal regardless of user interface; this is generically illustrated in FIG. 13.

Figure 9:
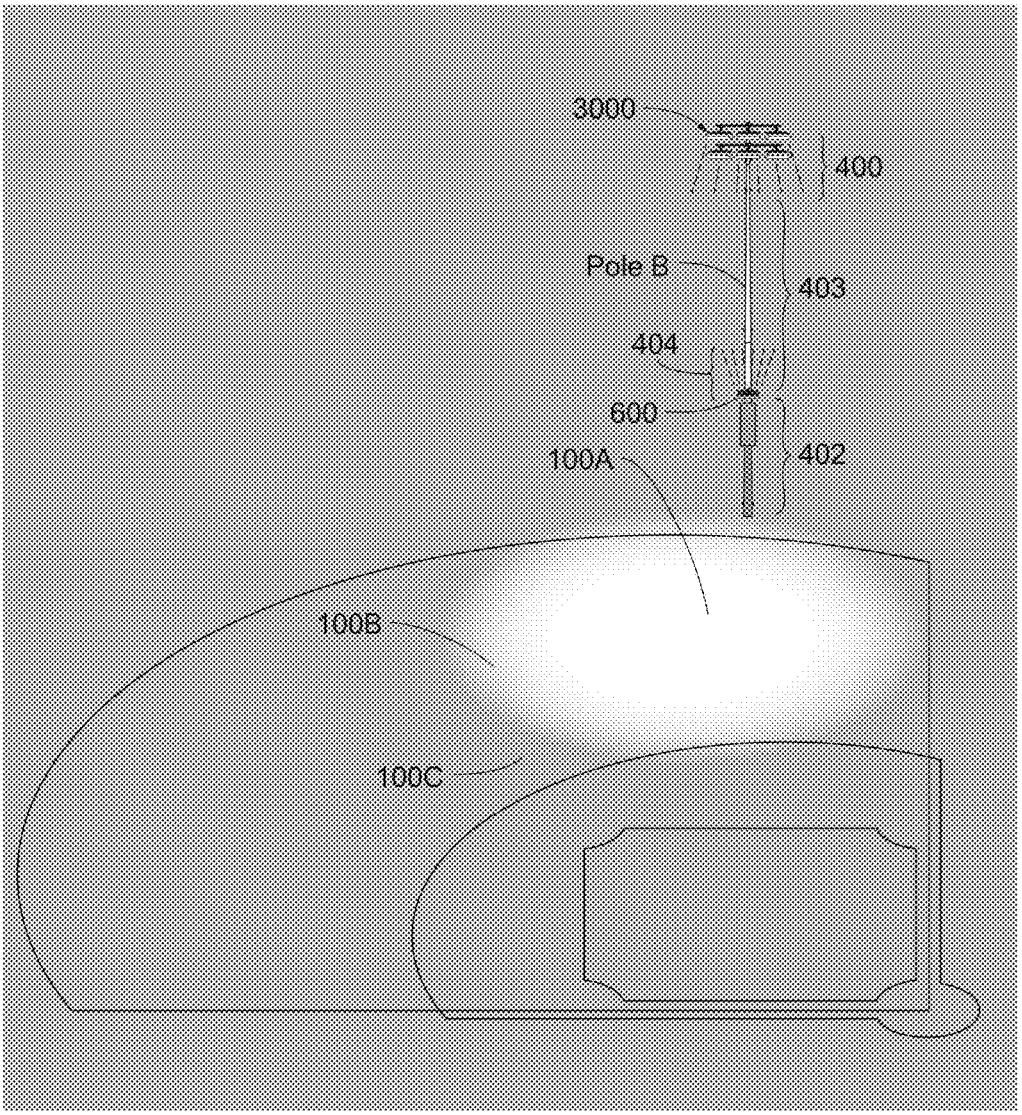
Figure 10:
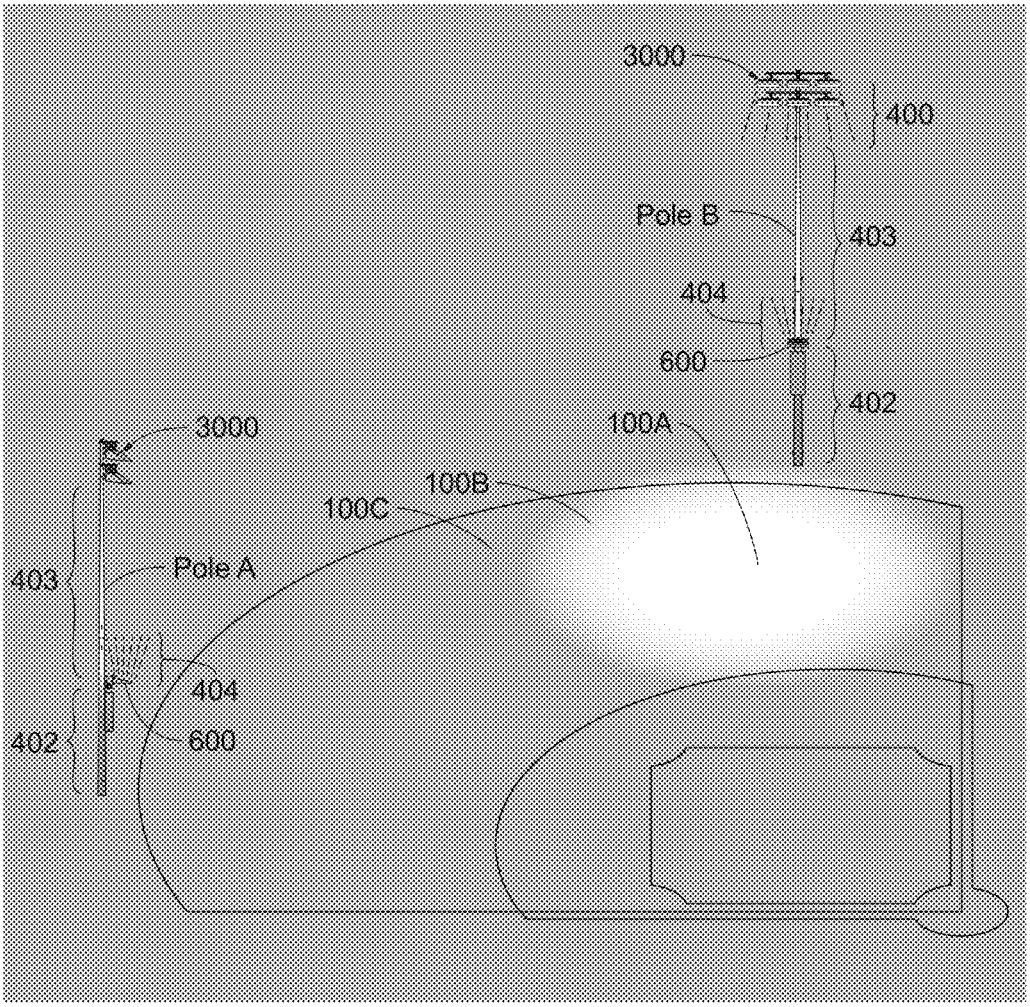
Figure 11:
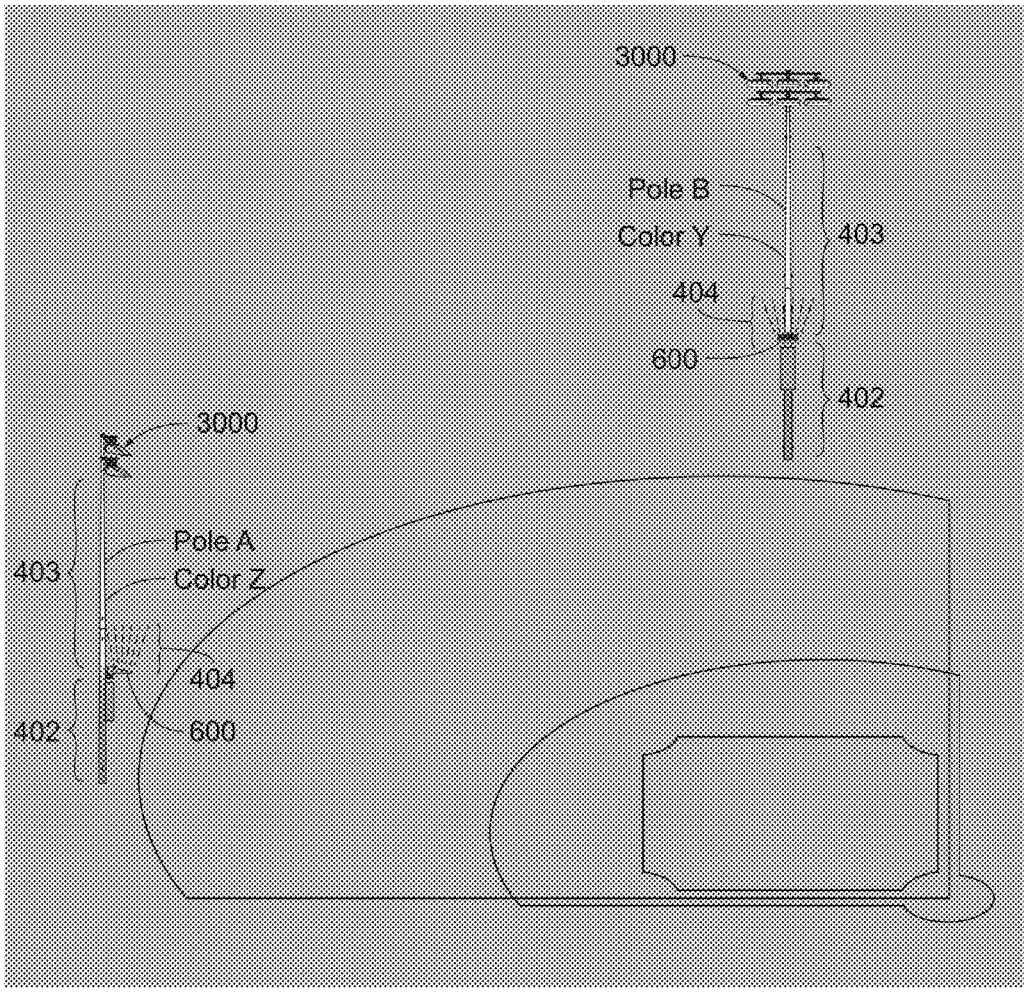

In terms of theatrical effects, a number of different ones are possible, and envisioned. As a first example, FIG. 9 illustrates a scenario in which primary illumination is provided by a composite beam 400 of an array 3000 of primary lighting fixtures 300 at the top of Pole B. A single secondary lighting fixture 600 provides illumination 404 of a section 403 of the pole; pole section 402 is still dark and not typically visible to a spectator. So from a spectator perspective, a portion 100A of the field is illuminated, a portion 403 of a pole is illuminated, and some (or none) of the primary lighting fixture light sources are visible when looking directly at the primary lighting fixture. It can be appreciated that all three of these sources of light could fade into one another, could be of different colors (e.g., selectively chosen to match a team's colors), selectively cycled to produce a flicker effect, or the like. Coordinated effects between individual composite beam patterns on a dark field, highlighted sections of a pole, and direct (but controlled) line-of-sight of an LED light source are not typical features a spectator sees in state-of-the-art lighting systems or light shows—initial tests have shown the impact on a spectator to be unexpected (which can be a desirable reaction to a theatrical event). FIG. 10 illustrates another scenario where a second pole (Pole A) is added, but instead of both primary and secondary illumination (400 and 404, respectively), only secondary illumination 404 on pole section 403 of Pole A is present; again, pole section 402 is dark and not typically viewable by a spectator. This provides for multiple surfaces to create multi-dimensional theatrical effects; in essence, a 3D theatrical effect in, at, and surrounding (or otherwise proximate or abutting) a target area as opposed to, for example, state-of-the-art approaches which only provide for 2D theatrical effects (e.g., by only illuminating playing field 100). FIG. 11 illustrates a third scenario in which no primary illumination is provided, and secondary illumination 404 differs in color from Pole A to Pole B such that pole sections 403 are different colors; again, pole sections 402 are dark and not typically viewable by a spectator. This provides for not only intensity fades or chase sequences, but color fades (e.g., so called ombre effects).

Figure 15:
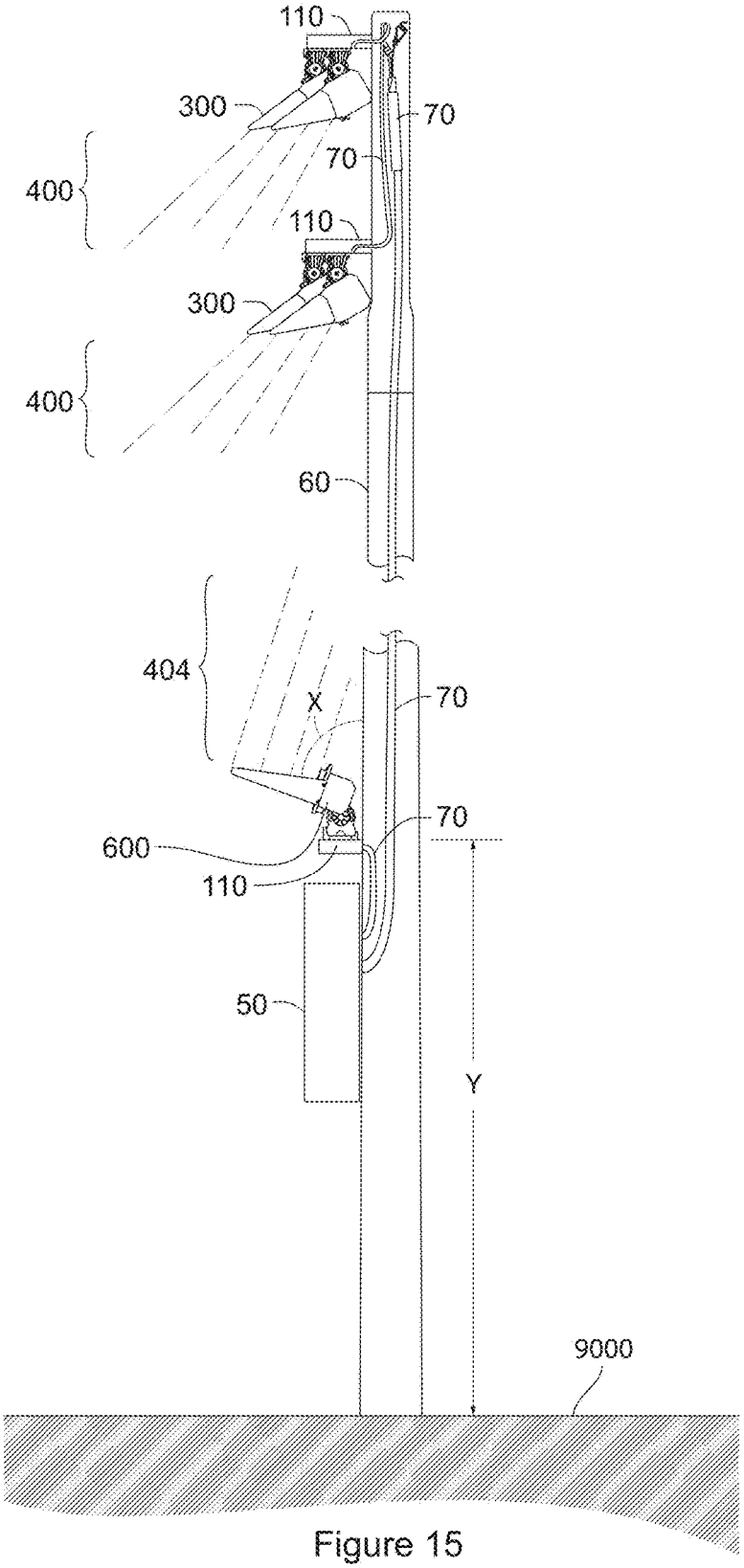
FIG. 15 illustrates a side view of one pole location of the lighting system of FIG. 5 designed in accordance with the method of FIG. 14 so to provide both primary and secondary lighting according to aspects of the present invention.

The mounting height Y and aiming angle X (see FIG. 15) of secondary LED lighting fixtures 600 can be varied from pole to pole to selectively determine which sections of pole 60 are highlighted, and at which points along a pole's height/length. Furthermore, because secondary lighting fixtures 600 are mounted proximate pole 60 (e.g., on the order of inches away from pole 60—just enough to permit pivoting via armature 200)—only one fixture operated at a low current is typically needed to illuminate a swath of pole 403 (e.g., on the order of a few tens of feet in length); again, this is due to the Inverse Square Law. In practice, it was found that a single secondary lighting fixture 600 (aforementioned model LiveLED 100) per pole could be operated at around 85 mA when primary fixtures were off, operated at around 450 mA while creating a slow color mix with primary lighting fixtures 300 on (a model similar to that in aforementioned U.S. patent application Ser. No. 15/782,039), and operated at around 850 mA while creating a fast color change with primary lighting fixtures 300 on—and the theatrical effects produced therefrom were readily perceivable from a spectator position. This is in stark comparison to producing the same theatrical effects from a poletop position onto the field (which required current on the order of over one thousand times higher (e.g., 2-7 A)). Additionally, by illuminating a surface other than the target area (i.e., the pole) by secondary lighting fixtures mounted proximate or to said surface, a spectator's eyes are drawn away from the target area to said surface. This enables a lighting designer to reduce current of the primary lighting fixtures and still provide theatrical effects in coordination with operation of the secondary lighting fixtures. Again, this is due to the high contrast of the dark background and small source size of the LEDs; namely, less light is needed to make the same theatrical impact when one lights the pole instead of the field.

Figure 12:
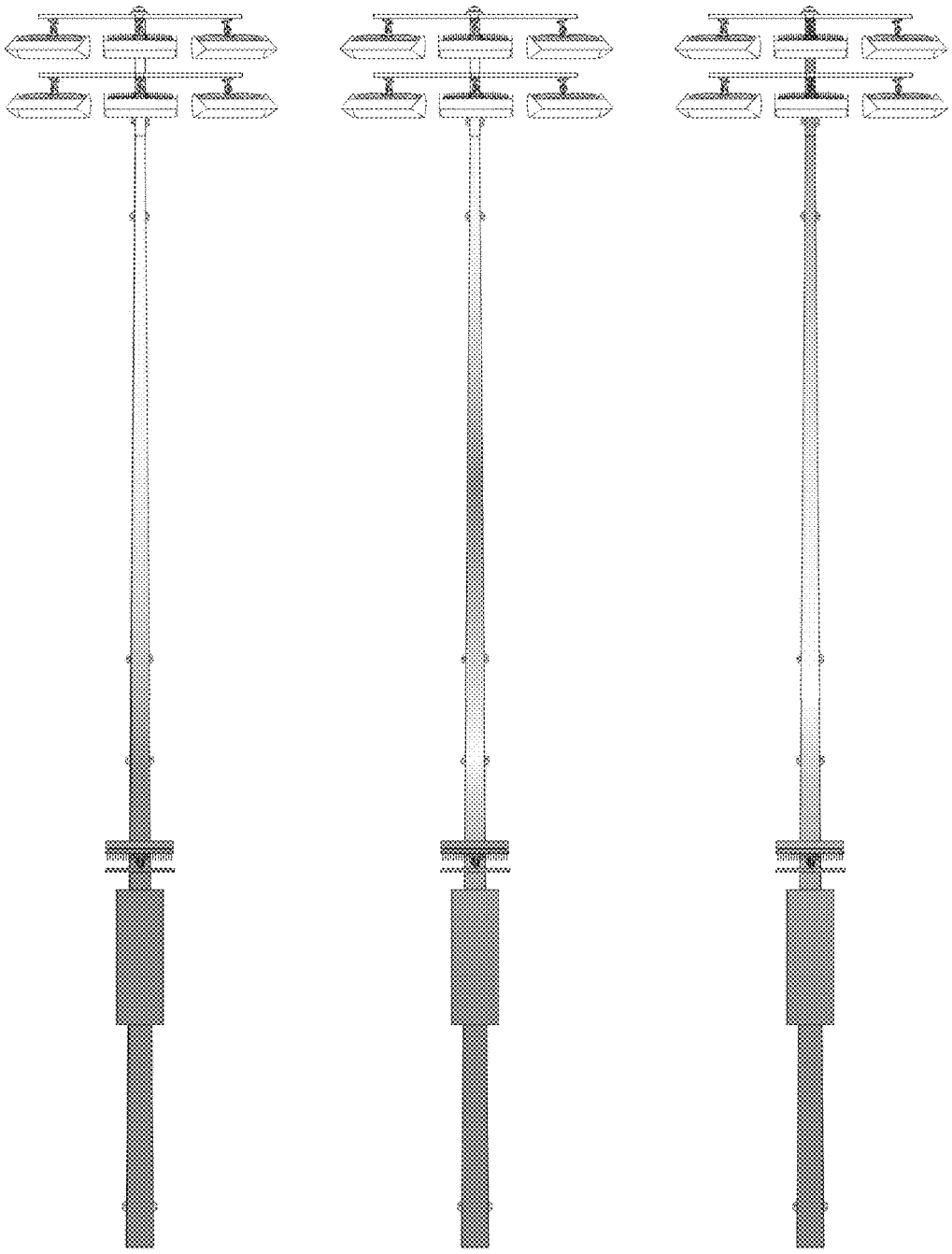

However, in some instances, one secondary lighting fixture 600 per pole may not be sufficient. For the middle scenario of FIG. 12, as an example, where there is a dark pole section between two lighted sections, two secondary LED lighting fixtures 600 could be mounted to the same pole at different aiming angles (e.g., side-by-side on a common crossarm and having pivoting capability via knuckle 200—see FIGS. 5B and 7 of incorporated U.S. Pat. No. 9,631,795 for two possible examples). Alternatively, a single secondary LED lighting fixture with at least two rows of LEDs could be used with a reflective device between rows so to split the beam; see, for example, reflective interior visor 503 or reflective strips 508 of FIG. 3B of incorporated U.S. Pat. No. 9,631,795 which could be placed between rows of LEDs within secondary fixture 600 so to redirect a portion of light upward and a portion of light downward as in the example section view of FIG. 16. Note how light (diagrammatically depicted by arrows) emitted from a first subset of LEDs (colored LEDs 1) is redirected in a different direction than light emitted directly from a second subset of LEDs (colored LEDs 2); the result is a split beam from a single fixture to produce two highlighted portions of pole 60 (middle scenario, FIG. 12), and which could be the same color or different depending on the types of LEDs in fixture 600.

Figure 14:
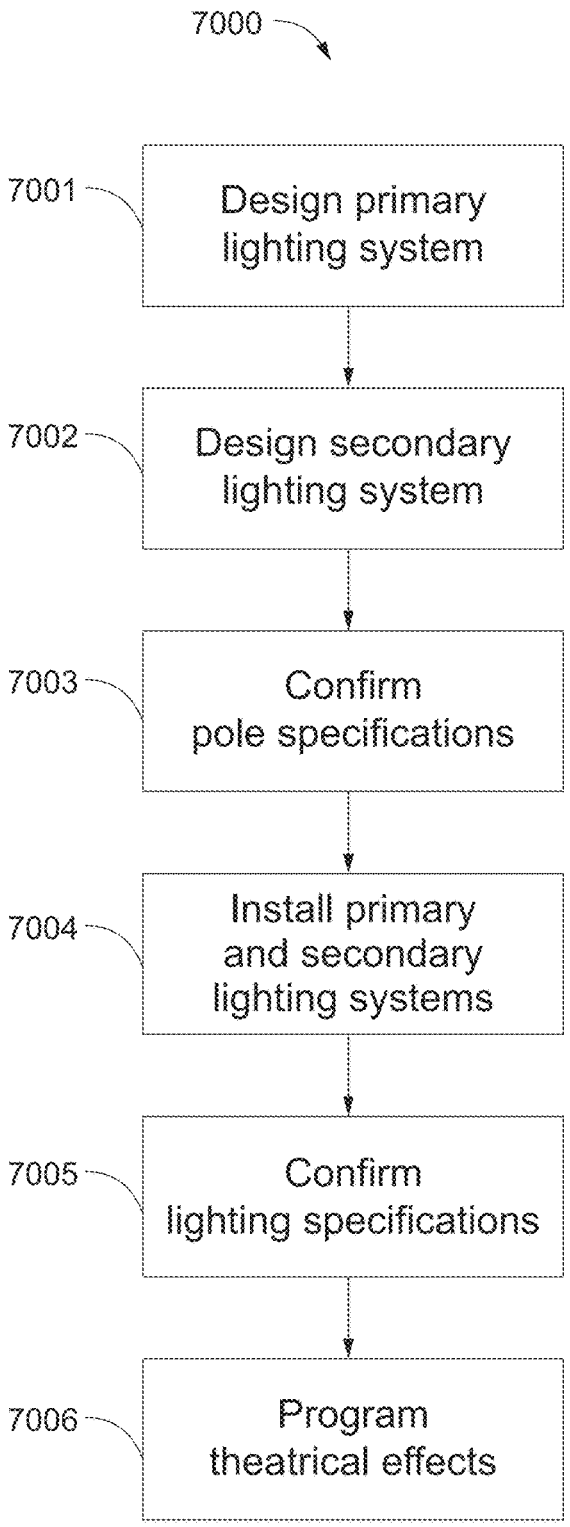
FIG. 14 illustrates one possible method of enhancing the spectator experience through theatrical effects according to aspects of the present invention by design, installation, and programming of a lighting system including both primary and secondary lighting.

All of the aforementioned can be achieved in a number of ways. One method 7000 for enhancing the spectator experience through theatrical effect by designing, installing, and programming a lighting system including both primary and secondary lighting fixtures on a common mounting structure is illustrated in FIG. 14, and flows thusly. According to a first step 7001 the primary lighting system is designed. The complexity of step 7001 will vary in accordance with the sport, level of play, whether or not sporting events are televised, site restrictions (e.g., proximity to residences or locations with restrictions on offsite glare or sky glow), and the like. For purposes of the present invention, determining site power, power wiring, and control apparatus and protocols are important as they inform other steps in the process. According to a second step 7002 the secondary lighting system is designed. As has been discussed, secondary lighting fixtures may be off-the-shelf, but if so, communication protocol, wiring, and the like may not match that of the primary lighting system (step 7001). It may be more practical to design the secondary lighting system on the same platform as the primary lighting system—for example, using the same housing and visoring system, but switching out high efficacy white LEDs for the same (or more likely, fewer) lower efficacy RGB LEDs for theatrical effect (RGB LEDs are typically lower efficacy due to e.g., losses in wavelength conversion materials). If the lighting application is a sports lighting application and the sport is an aerial sport (e.g., baseball), then the secondary lighting fixtures may need to be designed to shed any balls that might be otherwise trapped; see, for example, U.S. patent application Ser. No. 15/782,039 incorporated by reference herein in its entirety.

A third step 7003 includes confirming pole specifications; this is an important step because one or more secondary lighting fixtures are being included on the same pole as the primary lighting system and, as previously stated, poles have a certain capacity when it comes to wind loading and weight. A benefit of the present invention is that it is likely only one secondary lighting fixture will be required per pole, and so the added weight is likely not an issue—though, as has previously been discussed, additional secondary lighting fixtures per pole (including crossarms, bracketry, etc.) might be needed to produce some theatrical effects. Mounting height Y is such that power wiring for secondary lighting fixture 600 can be conditioned at cabinet 50 and internally routed, and so for most sports lighting applications is on the order of ten or more feet. Angle X—which is the angle of the emitting face of secondary LED lighting fixture 600 relative pole 60—can vary from less than 1 degree to on the order of 10 degrees depending on the taper of pole 60 and how large a swath of lit pole 430 is desirable, though this could differ. Changes in X and Y are unlikely to impact pole specifications as it is unlikely secondary LED lighting fixtures are at an angle or height to impact wind loading, but as it is possible in some extreme scenarios, step 7003 should take such into consideration.

According to a fourth step 7004 the primary and secondary lighting systems may be installed. Some primary lighting systems are shipped to a site pre-aimed, requiring only minor assembly and connection; details of this can be found in, for example, U.S. Pat. No. 8,300,219 incorporated by reference herein in its entirety. Secondary lighting fixtures could be likewise pre-aimed when shipped to site; otherwise secondary lighting fixtures may require a different approach to installation. In the case of LiveLED 100 fixtures, for example, a pole section may be drilled prior to shipping and said fixture secured at one end of the yoke-style mount to the pole in situ (after internally routing wiring), and aiming angle determined and set by tightening yoke bolts at the other end of the yoke-style mount. The complexity of step 7004 will depend, for example, on the design of the primary and secondary lighting fixtures, as well as whether poles 60 are delivered in sections, are set directly in the ground 9000 (which is unlikely for sports lighting applications), is bolted to a foundation, or is set, plumbed, and backfilled.

According to a fifth step 7005, lighting specifications are confirmed. Testing of horizontal and vertical footcandles at various spots on and in the target area is common in the art of lighting design for applications which require conformance to standards or codes; these sorts of measurements typically only impact the primary lighting. However, it is also beneficial to confirm specifications are met when secondary lighting fixtures are operational. For example, if a secondary lighting fixture 600 is aimed at too steep (i.e., too high) an angle, it may project light backwards towards a spectator's eye and cause glare. If a secondary lighting fixture is aimed at too shallow an angle, the swath of pole illuminated may be too small to be noticeable. Evaluation of the impact of secondary lighting in addition to verifying performance of primary lighting is contemplated by step 7005; as is in situ re-aiming of primary and/or secondary lighting fixtures.

According to a final step 7006 theatrical effects may be programmed via control of primary and/or secondary lighting fixtures. As previously discussed, there is potential for multi-dimensional theatrical effects; namely, light projected across multiple surfaces in multiple planes (as opposed to traditional theatrical lighting on a field or wall wash lighting of a water tower or façade). As one example, according to step 7006 a program may include lighting a section of pole by a secondary lighting fixture with a perceivably red color and "pulsing" the primary lighting fixtures on the same pole by varying current some amount at some frequency (preferably under 3 Hz or whatever is the generally acceptable threshold to avoid photosensitive epilepsy)—so to simulate a heartbeat—while all other primary lighting fixtures on other poles provide light at a reduced current on the field; here, there is lighting at the field, as well as at the surface of a pole (which is generally orthogonal to the field and in a different plane). Other designs, sequences, colors, and the like have already been discussed. Colors of secondary lighting fixtures could be altered through the year in accordance with holidays, seasons, colors of visiting sports teams, and the like. Primary and/or secondary lighting could be synchronized with prerecorded or live music (e.g., organ at a baseball game) to create an audio light show; in the former case, controls (e.g., touchpad 708) could be loaded with programmed effects (e.g., schedules with on/off/dim sequences coded to each fixture in an array) which are triggered when a particular piece of recorded music is selected from one or more available on touchpad 708 such that theatrical effects from the lights are synchronized to theatrical effects from non-lighting devices (here, music from speakers).

C. Options and Alternatives

The invention may take many forms and embodiments. The foregoing examples are but a few of those. To give some sense of some options and alternatives, a few examples are given below.

Figure 17:
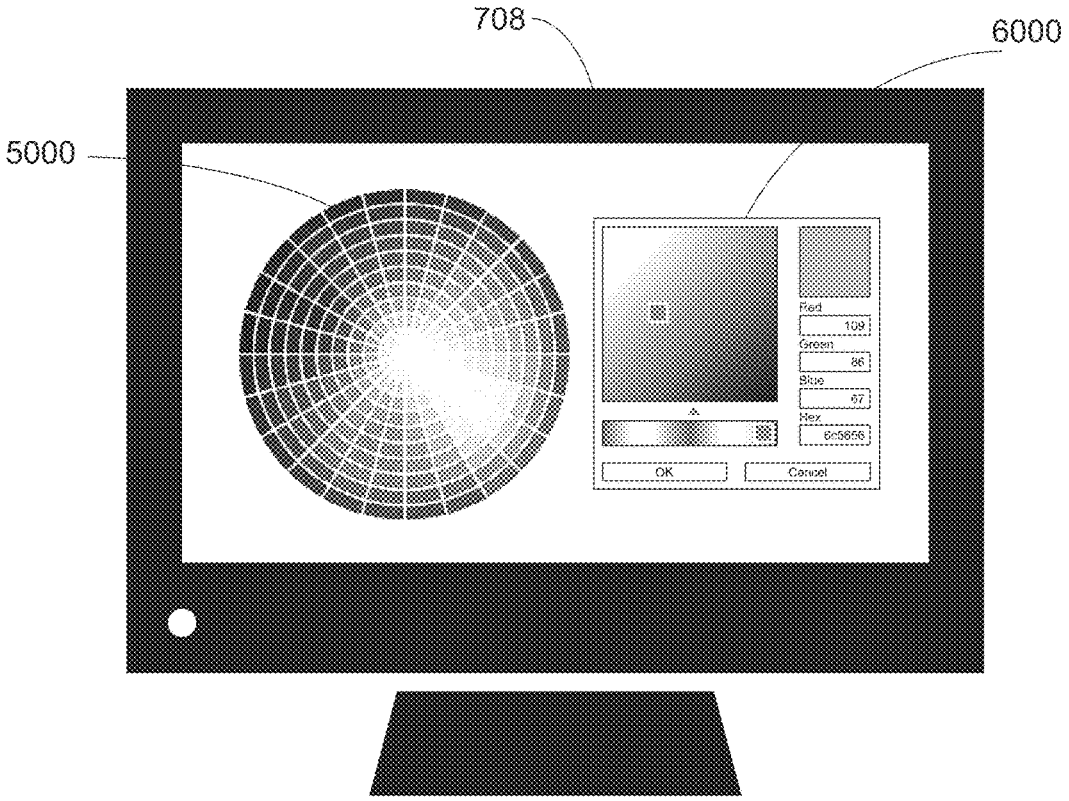
FIG. 17 illustrates alternative user interface options for programming the theatrical effects of FIGS. 9-12 according to aspects of the present invention.

As previously stated, secondary LED lighting fixtures could be off-the-shelf or custom for an application; this is likewise true for the primary LED lighting fixtures. A variety of controller and driver arrangements are possible when selecting primary and secondary LED lighting fixtures, as are color options, wiring options, communication protocols, and control platforms; all are possible and envisioned. Depending on the permutation selected, specific apparatus may differ from that illustrated herein; for example, a control module could be created which includes an inherent gateway and web server, or these components could be separate, or omitted entirely from the design. As another example, static mounts might be used instead of adjustable armatures 200 to reduce weight or potentially enable cost savings. As another example, secondary lighting fixtures may not include integral drivers, and so cabinets 50 may include additional drivers 1000. As yet another example, if there are multiple colors which could be produced by secondary lighting fixtures, user interfaces 705, 707, and/or 708 could include color wheels 5000 or RGB-type coordinate systems 6000 to better enable selection of theatrical effects; one possible example is illustrated in FIG. 17.

Likewise, specific methods may differ from that illustrated herein; for example, method 7000 may be expanded to include consideration of non-primary or secondary lighting (e.g., pulsing parking lot lighting during a touchdown) or non-lighting devices (e.g., coordinating secondary lighting to match intensity or color of scoreboards or stadium ticker tapes), or expanded to include consideration of all target areas at a single venue (e.g., programming a chase sequence across all poles of all fields at a sports complex). Method 7000 could be expanded to include a step of loading onsite control panels with preprogrammed lighting effects to permit at-will selection of theatrical effects. Method 7000 could even be expanded to include programming of effects of an instructional or informational nature rather than purely theatrical. For example, secondary lighting of poles in one quadrant of a sports field could be highlighted blue while all others poles at the sports field are highlighted green, and this particular theatrical effect might be preprogrammed but available for use at will (e.g., via touchpad 708) when certain activities occur only in that quadrant of the sports venue (e.g., proposals, seat dismissal, fan recognition); not only is theatrical effect provided, but it provides educational effect insomuch that it directs spectators' attention to a particular area within a larger target area. All of the aforementioned are possible, and envisioned.

In terms of providing colored lighting for theatrical effects, RGB-type LEDs, as well as color gels on, e.g., device 900, have been discussed. It is important to note these are but a few examples of what is possible and envisioned. For example, colored lighting could be provided via phosphors on the primary lens of the LEDs, or coatings on the secondary lenses of the LEDs, or treatment of a reflector associated with the LEDs. All of this could be achieved using the same housing and visoring system as the primary LED lighting fixtures (thereby ensuring a uniform look of lighting fixtures), but this could differ and not depart from at least some aspects of the present invention.

Finally, while discussion has been directed to sports lighting applications, it is important to note that aspects according to the present invention could apply to any lighting application where there is a need to provide primary lighting during nighttime or low ambient light conditions, and which may also benefit from secondary lighting for theatrical effects. For example, indoor stadiums (even if used for non-sporting events) may have poles, support structures, trusses, or the like which could highlighted to enhance primary lighting and/or provide theatrical effects according to aspects of the present invention.

What is claimed is:

1. A method of providing secondary lighting so to provide theatrical effects in a manner that does not interfere with primary lighting of a target area by a primary lighting system comprising:

a. mounting the primary lighting system at a poletop position on one or more poles abutting the target area;
b. mounting the secondary lighting system on the one or more poles at a position other than poletop;
c. aiming the primary lighting system towards the target area so to provide primary lighting of the target area when the primary lighting system is operated;
d. aiming the secondary lighting system towards the pole so to provide secondary lighting of a surface other than that of the target area when the secondary lighting system is operated; and
e. operating the secondary lighting system in accordance with one or more triggers to provide theatrical effects at the surface without interfering with primary lighting of the target area.

2. The method of claim 1 wherein the target area comprises a sports field, and wherein the one or more poles abutting the target area comprise one or more poles surrounding the sports field.

3. The method of claim 2 wherein the target area further comprises an aerial space above the sports field, and wherein a portion of the primary lighting system provides lighting of the aerial space above the sports field.

4. The method of claim 1 wherein operation of the secondary lighting system is at a lower current than operation of the primary lighting system.

5. The method of claim 1 wherein the secondary lighting is of a different perceivable color than that of the primary lighting.

6. The method of claim 1 wherein a timing of the one or more triggers is one or more of:

a. random;
b. predetermined;

c. semi-random; and
d. at will.

7. The method of claim 6 wherein the predetermined timing of the one or more triggers comprises one or more of:
a. sunrise;
b. sunset;
c. time of day; and
d. synchronization with a non-lighting device.

8. The method of claim 7 wherein the non-lighting device comprises one or more of:
a. a scoreboard;
b. a ticker tape; and
c. a speaker.

9. The method of claim 1 wherein the secondary lighting system is operated when the primary lighting system is not.

10. The method of claim 9 wherein the secondary lighting system is also operated when the primary lighting system is operated, and wherein operation of the primary and secondary lighting systems is coordinated to produce the theatrical effect.

11. A secondary lighting system for providing theatrical effects at a target area primarily lit by a primary lighting system without interfering with operation of the primary lighting system comprising:
a. a secondary lighting fixture adapted to emit light of selectable characteristics;
b. an armature adapted to affix the secondary lighting fixture to a common support structure of the primary lighting system at an angle such that light emitted from the secondary lighting fixture lights a surface other than that of the target area;
c. a control module adapted to control emission of the light from the secondary lighting fixture;
d. a user interface adapted to define one or more triggers for controlling the secondary lighting fixture; and
e. communication means to communicate the trigger from the user interface to the control module so to control emission of the light from the secondary lighting fixture to provide theatrical effects.

12. The system of claim 11 wherein the surface other than that of the target area comprises a swath of the common support structure.

13. The system of claim 11 wherein the armature is adjustable, and wherein an aiming angle of the secondary lighting fixture relative the common support structure is selectable in situ.

14. The system of claim 11 wherein the selectable characteristics of the emitted light of the secondary lighting fixture comprises:
a. size;
b. shape;
c. intensity; and
d. color.

15. The system of claim 11 wherein the trigger comprises one or more of:
a. sunrise;
b. sunset;
c. time of day; and
d. synchronization with a non-lighting device.

16. The system of claim 11 wherein the target area comprises a sports field, and wherein the non-lighting device comprises one or more of:
a. a scoreboard;
b. a ticker tape; and
c. a speaker.

17. The system of claim 11 wherein the secondary lighting fixture has a lower rated operating wattage than a lighting fixture of the primary lighting system.

18. A method of providing ambiance or theatrical effects from a secondary lighting system while simultaneously providing specific light levels and lighting uniformity from a primary lighting system to adequately perform specific tasks at a target area during nighttime or low ambient light conditions comprising:
a. mounting the primary lighting system at a poletop position on one or more support structures abutting the target area;
b. installing the secondary lighting system of claim 11 at the target area;
c. aiming one or more primary lighting fixtures of the primary lighting system towards the target area so to provide the specific light levels and lighting uniformity when the primary lighting system is operated;
d. aiming the secondary lighting fixtures of the secondary lighting system towards the common support structure so to provide the ambiance or theatrical effects when the secondary lighting system is operated; and
e. operating both the primary lighting system and the secondary lighting system in accordance with one or more triggers to provide ambiance or theatrical effects from a secondary lighting system while simultaneously providing specific light levels and lighting uniformity.

19. The method of claim 18 wherein the secondary lighting system emits light of a different perceivable color than that of a light emitted by the primary lighting system.

20. The method of claim 18 wherein the target area comprises a sports field, and wherein the one or more support structures abutting the target area comprises one or more poles surrounding the sports field.

21. The method of claim 18 wherein:
a. the control module of the secondary lighting system is further adapted to control emission of light from the primary lighting system; and
b. the user interface of the secondary lighting system is further adapted to define one or more triggers for controlling the primary lighting system;
c. so that the operating of both the primary and secondary lighting systems in accordance with one or more triggers to provide ambiance or theatrical effects from a secondary lighting system while simultaneously providing specific light levels and lighting uniformity is facilitated from a single user interface.

* * * * *